US005735702A

United States Patent [19]

Hio

[11] Patent Number: 5,735,702

[45] Date of Patent: Apr. 7, 1998

[54] LEVER TYPE CONNECTOR

[75] Inventor: Masahide Hio, Yokkaichi, Japan

[73] Assignee: Sumitomo Wiring Systems, Ltd., Japan

[21] Appl. No.: 630,039

[22] Filed: Apr. 2, 1996

[30] Foreign Application Priority Data

| | | | |
|---|---|---|---|
| Apr. 7, 1995 | [JP] | Japan | 7-108087 |
| Apr. 11, 1995 | [JP] | Japan | 7-111145 |
| Apr. 11, 1995 | [JP] | Japan | 7-111146 |
| Apr. 25, 1995 | [JP] | Japan | 7-125731 |
| Apr. 25, 1995 | [JP] | Japan | 7-125735 |

[51] Int. Cl.[6] ..... H01R 13/62

[52] U.S. Cl. ..... 439/157; 439/468; 439/271

[58] Field of Search ..... 439/157, 153, 439/155, 271, 283, 310, 372, 468, 473, 521

[56] References Cited

U.S. PATENT DOCUMENTS

| | | | |
|---|---|---|---|
| 4,820,181 | 4/1989 | Kuzuno et al. | 439/283 |
| 4,917,620 | 4/1990 | Samejima et al. | 439/271 |
| 5,076,802 | 12/1991 | Colleran et al. | 439/468 |
| 5,174,785 | 12/1992 | Endo et al. | 439/312 |
| 5,238,417 | 8/1993 | Hatagishi | 439/153 |
| 5,257,942 | 11/1993 | Taguchi | 439/153 |
| 5,484,301 | 1/1996 | Koumatsu et al. | 439/271 |
| 5,575,671 | 11/1996 | Katsuma | 439/157 |

FOREIGN PATENT DOCUMENTS

| | | |
|---|---|---|
| 0549370 | 6/1993 | European Pat. Off. . |
| 0585562 | 3/1994 | European Pat. Off. . |
| 0599332 | 6/1994 | European Pat. Off. . |
| 0646994 | 4/1995 | European Pat. Off. . |
| 462772 | 2/1992 | Japan . |
| 629035 | 4/1994 | Japan . |
| 645275 | 6/1994 | Japan . |
| 648182 | 6/1994 | Japan . |

*Primary Examiner*—Gary F. Paumen
*Assistant Examiner*—Tho Dac Ta
*Attorney, Agent, or Firm*—Jordan B. Bierman; Bierman, Muserlian and Lucas

[57] ABSTRACT

A lever type connector wherein a pair of housings are interconnected by turning a lever attached to one of the housings, comprises: a housing containing a plurality of terminals each of which is adapted to be detachably coupled to each of a plurality of mating terminals contained in a mating housing and drawing out an electric wire clamped in each terminal through a wire-drawing surface; a pair of support axles formed on the housing; a U-shaped lever rotatably and detachably mounted on the housing by coupling the pair of support axles in a pair of bearing holes formed in opposed leg portions of the lever, respectively; a cover detachably mounted on the wire-drawing surface of the housing to protect the electric wires; and means for positioning the cover at a given mounting position on the housing, the positioning means including engaging portions formed on the housing and cover. The lever is selectively mounted on the housing in a reversible manner upon coupling between the pairs of support axles and bearing holes.

12 Claims, 14 Drawing Sheets

LEVER TYPE CONNECTOR

BACKGROUND OF THE INVENTION (1) Field of the Invention

This invention relates to a lever type connector in which a pair of housings are coupled to each other by operating a lever and more particularly relates to a lever type connector which is able to easily draw out electric wires, conveniently mount and detach the lever on and from the housing, and has a waterproofing function.

(2) Statement of the Prior Art

A lever type connector in which a pair of male and female housings are interconnected to each other by a lever has the following structure. A U-shaped lever is coupled to one of the housings by inserting a pair of support axles into a pair of bearing holes formed in legs of the lever. When the lever is turned about the support axles with projections on the other housing being fitted in cam grooves formed in the legs of the lever, both housings are readily attracted and interconnected to each other.

Usually, coupling resistances are generated by frictional forces due to elastic contacts between male and female terminals contained in both housings upon coupling the male and female housing. Particularly, the coupling resistances are greater in a connector having many poles. However, in the lever type connector, even a slight operational force can generate a great coupling force by means of "a lever action", thereby effecting the coupling operation easily.

In the lever type connector, an attaching posture on the housing depends upon an engagement of cam grooves and bosses. For example, in the case where the lever type connector has to be mounted in a narrow space and the mounting posture is restricted, it is impossible to define a sufficient space around a turning region of the lever. In this case, it will be difficult to operate the and inefficient to interconnect the housings.

In a connector which interconnects a pair of male and female housings, electric wires connected to terminals contained in the respective housings are drawn out of a rear side surface opposite to a fitting surface to a mating housing. When such a connector is mounted in, for example, a narrow space and a given sense, it is often impossible to property arrange the wires drawn out of the rear surface of each housing.

In such a case, the wires are bent and arranged along the rear surface. A cover is mounted on the rear surface to maintain the wires in the bent state and the wires are taken out of a wire outlet in the cover in a direction along the rear surface. Such a cover can bundle the wires together and facilitate to handle the connector and to effect a taping work.

In a conventional connector, an attaching direction of a cover to a housing is predetermined. Consequently, if the attaching direction of a housing to a stationary member is restricted, an exit direction of the electric wires from a wire outlet in the cover is also limited. In the case where there is not sufficient space to remove the wires in front of the housing, the wires have to be bent and directed toward a larger space, thus causing stress to the wires, and the length of the arranged wires to be greater.

In the lever type connector, a U-shaped lever is pivotably mounted on one of a pair of housings and turned with cam grooves in the lever being engaged with bosses on the other housing, whereby the housings are interconnected. When coupling of the housings is completed, the lever is locked on the one housing with an operational handle of the lever being brought into close contact with the outer surface of the one housing. This prevents the lever from turning to a detaching direction by accident.

However, in such a construction, it is difficult to smoothly operate the lever to disconnect the housings. This is because the lever is difficult to operate manually even if it is unlocked. In particular, operation of the lever becomes difficult when the lever type connector must be attached by touch without visual access.

As a means for overcoming the above problems, there has been proposed a structure in which torsion springs are provided on pivotable portions of a lever to slightly separate it from the housing. However, this structure results in an increase in the number of parts and assembling steps and thus increases costs.

On the other hand, an example of a waterproofing structure in a conventional lever type connector will be explained below by referring now to FIG. 32 for convenience of explanation. FIG. 32 is a longitudinal sectional view of a part of a conventional waterproofed connector.

As shown in FIG. 32, the waterproofed connector comprises a male housing 2 containing male terminals 1, a female housing 4 containing female terminals 3, and a rubber ring 5 mounted on the female housing 4. In this waterproofed connector, when the housings approach each other, the terminals 1 and 3 are coupled to each other and a hood 6 of the male housing 2 comes into close contact with the rubber ring 5 from the outer peripheral side and compresses it elastically. An elastic recovery force in the rubber ring 5 effects waterproofing between the housings 2 and 4.

Generally, the male housing 2 can move relative to the female housing 4 in a direction perpendicular to a coupling direction of the housings within a tolerance of working and assembling. Once the terminals 1 and 3 are interconnected to each other, the housings cannot move relative to each other in a direction along the contact faces of the terminals 1 and 3 by frictional resistances due to an electric force generated in elastic contact pieces of the female terminals 3.

When the terminals 1 and 3 are interconnected to each other with a relative displacement S between the housings 2 and 4 in the above direction remaining, coupling of the displaced housings 2 and 4 proceeds as it is. Consequently, compression of the rubber ring 5 is unequal between opposite sides of the housings 2 and 5 thus causing a potential for faulty sealing. In a worst case, one side of the rubber ring 5 is not compressed at all.

Although the elastic recovery force in the rubber ring 5 acts on both housings 2 and 4 to correct displacement after interconnecting the terminals 1 and 3, the elastic recovery force cannot correct displacement once the terminals 1 and 3 have been interconnected to each other, as it is far smaller than the frictional resistances occurring between the terminals 1 and 3.

Such problems arise with greater frequency in a connector having more terminals to be interconnected.

Moreover, the rubber ring 5 is closely mounted on the outer periphery of the female housing 4 and an inner end face 7 of the rubber ring 5 is brought into contact with a bearing face 8 on the female housing 4. The male housing 2 is coupled to the female housing 4 with the hood 6 of the male housing 2 being in close elastic contact with the outer periphery of the rubber ring 5.

At this time, the rubber ring 5 is acted on by a force towards the inner part caused by the frictional resistance between the rubber ring 5 and the hood 6. This pressing force acting on the rubber ring 5 is received on the bearing face 8 of the female housing 4, thereby restraining the rubber ring 5 from moving to an inner position from a regular mounting position. Thus, the rubber ring 5 can be elastically clamped between the outer periphery of the female housing 4 and the inner periphery of the hood 6 and the elastic recovery force in the rubber ring 5 performs a waterproofing function between the female housing 4 and the hood 6.

However, in a conventional waterproofed connector, the bearing face 8 is formed perpendicularly to an outer periphery 9 in the female housing 4 and a connecting face 98 between the outer periphery 9 and the bearing face 8 is formed into a curved face on account of a forming condition. When the rubber ring 5 is pushed, the rubber ring 5 moves in the coupling direction while elastically deforming the distal end outwardly along the bearing face 8, as shown in FIG. 32.

In this case, not only contacted areas between the rubber ring 5 and the female housing 4 and between the ring 5 and the hood 6 become so small that the sealing function is lowered, but also the distal end of the hood 6 is brought into contact with the elastically deformed portion of the rubber ring 5, so that the housings 2 and 4 cannot move to a regular position relative to each other. This may cause a failure in contact between the terminals 1 and 3.

Such a problem will often occur in the case where a thickness of the rubber ring 5 is smaller than its length in the coupling direction of the housings.

SUMMARY OF THE INVENTION

An object of the present invention is to provide a lever type connector which enables easy handling of a lever even in restricted areas.

Another object of the present invention is to provide a lever type connector which can achieve a high variance in direction selectivity in which electric wires are bent and arranged along a rear side of a housing.

Still another object of the present invention is to provide a lever type connector which can easily release a lever from a housing.

Still another object of the present invention is to provide a lever type connector which can correct a relative displacement between housings in a direction intersecting a fitting direction.

Still another object of the present invention is to provide a lever type connector which can prevent a rubber ring from becoming displaced axially upon fitting of housings.

In order to achieve the above objects, a lever type connector in accordance with the present invention, in which a pair of housings are interconnected by turning a lever attached to one of the housings, comprises: a housing containing a plurality of terminals each of which is adapted to be detachably coupled to each of a plurality of mating terminals contained in a mating housing and drawing out an electric wire clamped in each terminal through a wire-drawing surface; a pair of support axles formed on the housing; a U-shaped lever rotatably and detachably mounted on the housing by coupling the pair of support axles in a pair of bearing holes formed in opposed leg portions of the lever, respectively; a cover detachably mounted on the wire-drawing surface of the housing to protect the electric wires; and means for positioning the cover at a given mounting position on the housing. The positioning means includes engaging portions formed on the housing and cover. The lever is selectively mounted on the housing in a reversible manner upon coupling between the pairs of support axles and bearing holes. A locking mechanism is provided on the support axles and bearing holes so as to restrain the leg portions from coming out of said housing after the bearing holes receive the support axles in the axial direction. The locking mechanism is formed into a symmetrical configuration with respect to an axis parallel to the coupling direction of the terminals.

In the present invention, it is possible to mount the lever on the housing in one of two fitting combinations between the pair of support axles and the pair of bearing holes.

Even if any force is applied to the leg portions of the lever so as to detach the lever from the support axles upon interconnecting of the pair of housings, the locking mechanism provided on the support axles and bearing holes interlocks to prevent the leg portions from coming out of the support axles. Also, since the enlarged portions are disposed symmetrically with respect to the axis in the fitting direction, the postures of the lever mounted on the housing by two ways of the combinations described above are symmetrical with respect to the axis in the fitting direction.

The locking mechanism includes a pair of enlarged portions projecting radially from the outer periphery of each support axle and a pair of recesses in the inner periphery of each bearing hole. Each of the recess is formed into a complementary shape with respect to each of the enlarged portions. The pair of enlarged portions and the pair of bearing holes are arranged symmetrically with the axis of the support axles. One couple of complementary enlarged portion and recess is different in shape from the other couple of complementary enlarged portion and recess.

In this construction, the attachment and detachment of the lever are effected by fitting the support axles in the bearing holes with the recesses being aligned with the enlarged portions. Even if a force acts on the leg portions of the lever upon interconnecting of the housings, the leg portions will not be detached from the support axles since the enlarged portions engage with the outer surfaces of the leg portions.

Since the enlarged portions are disposed on the support axle in symmetry with the axis of the support axle, engagement of the enlarged portions with the leg portions is stabilized and enhanced in strength. Also, since the enlarged portions and recesses opposed to each other are different in shape, a combination of the enlarged portions and recesses is determined in only one way in each of two mounting positions of the lever. Accordingly, the mounting postures of the lever are symmetrical with respect to the axis of the fitting direction of the housings.

The recess is disposed in the bearing hole to be fitted to the enlarged portions when the lever is turned beyond a range for coupling the terminals.

In this construction, the enlarged portions are not aligned with the recesses while the housings are coupled to each other by operation of the lever, thereby maintaining engagement between the enlarged portions and the outer surfaces of the leg portions during the coupling operation.

The supported axles are disposed on the housing so that the clockwise and counterclockwise moments around the support axles caused by the coupling resistances between the terminals are balanced with respect to each other.

In this construction, there is no interference between the housings on account of relative inclination of the housings caused by the coupling resistances, since the clockwise and counterclockwise moments around the support axles caused by the coupling resistances are balanced with respect to each other even if the lever is mounted on the housing in either direction defined by the combinations of the pairs of support axles and bearing holes.

According to the present invention, it is possible to improve the handling operation of the lever, since the direction of attaching the lever can be determined in compliance with the attaching condition.

Since the locking mechanism provided on the support axles and the bearing holes can prevent the leg portions from coming out of the support axles during the coupling operation, a stable and positive turning operation of the lever can be obtained. Also, since the locking mechanism on the side of the support axles is symmetrical with respect to the axis of the coupling direction, the support axles can be readily fitted in the bearing holes in either combination between the pairs of the support axles and bearing holes.

Since the enlarged portions can prevent the leg portions from coming out of the support axles during the coupling operation, the stable and positive turning action can be effected. Also, since the enlarged portions are disposed symmetrically with respect to the axis of the support axles, the leg portions can be prevented stably and positively from coming out of the support axles. The lever is not mounted in an incorrect position on the housing regardless of the direction of attachment of the lever, since the opposite enlarged portions are different in shape so that the mounting postures of the lever are symmetrical with the axis of the coupling direction.

It is possible to prevent detachment of the lever against a force which causes the lever to become detached from the support axles, since the enlarged portions are not aligned with the recesses during the turning operation of the lever.

Handling of the lever can be easily effected, since the relative posture between the housings is not disturbed due to the coupling resistances between the terminals in either combination of the pairs of supports axles and bearing holes.

The cover is adapted to withdraw the wires together through a wire outlet along the wire-drawing surface on the housing. The positioning means in at least one of the cover and housing are disposed symmetrically with respect to the wire-exit direction from the wire outlet. The cover can be mounted on the housing selectively so as to direct the outlet in a reverse direction.

In this construction, since the positioning means are disposed symmetrically with respect to the wire-exit direction from the wire outlet, the cover can be located in the given mounting position on the housing by the positioning means even if the lever is mounted on the housing in either direction of the wire outlet.

The positioning means includes a pair of parallel guides formed on the housing to extend towards the wire outlet along the wire-drawing surface, a pair of fitting grooves formed on the cover to extend towards the wire outlet so as to slidably receive the guides, and a stopper for limiting the sliding movement of the cover on the housing within a given distance.

In this construction, the cover is attached to the housing while sliding the cover on the housing along the wire-exit direction by engaging the guides with the fitting grooves and the cover is located at a given position by the stoppers. Then, the electric wires drawn out of the wire-drawing surface are contained in the cover and naturally bent along the inner periphery thereof towards the wire outlet. When the mounting operation of the cover is completed, the wires are drawn out of the wire outlet together.

The housing and cover are provided with lock members which serve to lock the cover at a given mounting position when the members are coupled to each other. Two lock members on the cover are disposed symmetrically with respect to an axis of the wire-exit direction while two lock members on the housing are disposed symmetrically with respect to an axis of the wire-exit direction.

In this construction, the lock members on the cover can engage with the lock members on the housing even if the cover is mounted on the housing in either one of two senses in the wire-exit direction, since the lock members on the housing are disposed symmetrically with respect to the axis of the wire-exit direction. In particular, since the lock members are symmetrical with respect to the axis of the wire-exit direction, the lock members disposed on opposite sides of the axis engage with each other.

According to the present invention, it is possible to arrange electric wires in equipment without further bending such wires drawn out of the wire outlet in a cover even if effected in a distracted environment, since the wires can be drawn out in either one of two opposite directions on the wire-drawing surface of the housing. Consequently, it is possible to avoid stressing the wires or increasing their length.

It is possible to contain and bundle together the electric wires in the cover by mounting the cover on the housing while sliding it in the wire-exit direction. Accordingly, the lever type connector of the present invention is more convenient than a conventional lever type connector in which a cover is mounted straight towards a wire-drawing surface of a housing while bundling the wires manually, since it is unnecessary to bundle the wires manually beforehand and the wires will not be clamped between the wire-drawing surface and the cover by accident.

Since the cover is locked on the housing by two lock members disposed symmetrically with respect to the axis of the wire-exit direction, the cover can be more positively locked at the opposite sides from the axis than locking at a single side.

The lever can turn between a fitting position in which a pair of housings are interconnected and a detached position in which both housings are disconnected from each other. The handle of the lever is adapted to approach the housing when the lever turns to the fitting position. The housing is provided with a lock member which can move between a locked position in which the lever is maintained by engagement with the lock member and an unlocked position in which the lever is released by the disengagement from the lock member and with a lock-releasing member which can apply a force in an unlocking direction to the lever in the locked position when said lock member is moved to the unlocked position.

In this construction, when the lock member is displaced from the locked position to the unlocked position while maintaining the lever in the fitting position in order to disconnect the housings from each other, the lever is unlocked and permitted to move to the detaching direction. Then, the lever can move to the detaching position by an action from the lock-releasing member. Since the operational handle is moved away from the housing, a worker can access it to move it in a detaching direction.

The lock-releasing member includes a pressure part for pressing the lever to an unlocked position and can be elastically deflected and displaced together with the lock member. The pressure part enters a space between the handle of the lever in the coupling position and the housing when the lock-releasing member is displaced to the unlocked position while elastically deflecting the lock-releasing member.

In this construction, when the lock-releasing member is displaced together with the lock member to the unlocked position while the lock-releasing member is elastically deflected, the locking of the lever is released and the pressure part enters the space between the operational handle and the housing. When the elastic deflection of the lock-releasing member is released from the above state, the pressure part pushes the lever to the unlocked position under the elastic recovery force of the lock-releasing member.

The lock-releasing member is provided with a holding piece which can hold the lock member in the locked position when the holding piece engages with the housing and can be released from the housing by means of the elastic deflection of the lock-releasing member.

In this construction, since the holding piece is detached from the housing to permit the lock member to move to the unlocked position when the lock-releasing member is elastically deflected the lock-releasing member can move to the unlocked position while being elastically deflected.

According to the present invention, it is possible to easily operate the lever even under restricted condition.

In addition, since it is possible to bias the lever to the unlocked position at a time when the lock member is displaced to the unlocked position and the lever is unlocked, a moving stroke of the lock member becomes shorter than that of a lever which is pushed on a shape or the like to the unlocked position while further displacing the lock member after unlocking.

Since the pressure part enters the space between the lever and the housing by means of elastic deflection of the lock-releasing member, it is possible to displace the pressure part to the unlocked position without interfering with the lever. Thus, displacement to the unlocked position can be readily carried out without causing any resistance or disturbance due to interference between the pressure part and the lever.

Since the lock member is maintained in the locked position, the lever is positively locked in the fitting posture, thereby holding both housings positively in the coupling state.

In addition, it is possible to unlock the lock member by a simple operation of elastically deforming the lock-releasing member and proceeding with the operation of displacing the lock member to the unlocked position, thereby enhancing work efficiency.

The terminals contained in the housings are interconnected in connection with the interconnection of both housings. A rubber ring mounted on the housing is pressed by the mating housing, thereby waterproofing the interiors of the housings. The mating housing commences to elastically engage with the rubber ring prior to the interconnection of the terminals upon interconnection of the housings, whereby the rubber ring applies an elastic force to the housings to correct a relative displacement between the housings in a direction across the coupling direction.

In this connection, the mating housing commences to elastically engage with the rubber ring prior to the interconnection of the terminals. At this time, in the case where some displacement between the housings is caused in a direction counter to the coupling direction, the elastic force in the rubber ring corrects such relative displacement between the housings. Then, the terminals come to fit each other and the housings are interconnected to each other while maintaining a correct positional relationship.

According to the present invention, since relative displacement between the housings is corrected by engagement of the mating housing with the rubber ring before fitting the terminals to each other, an amount of compression of the rubber ring is uniform in a complete coupling state, thereby preventing any deterioration in sealing which may result from uneven compression.

One of a pair of housings to be interconnected supports a waterproofing rubber ring so that an inner end face of the rubber ring abuts on a bearing face formed on the one housing. The bearing face receives a pressure force against the rubber ring in the fitting direction caused by frictional resistances between the housings upon their interconnection. The bearing face is provided with means for restraining the rubber ring from separating from the one housing at the inner end when the rubber ring is acted on by a pressure force in the coupling direction.

In this construction, in the case where the rubber ring is compressed in the coupling direction, the inner end of the rubber ring is restrained from separating from the one housing by means of the restraining means provided on the bearing face.

The restraining means is formed into a tapered shape so that the bearing face is slanted with respect to a face perpendicular to the coupling direction of the rubber ring. A face on the rubber ring confronting the bearing face is formed into a tapered shape with the same slanting angle as that of the bearing face.

In this construction, in the case where the rubber ring is compressed in the coupling direction, the inner end of the rubber ring is restrained from separating from the one housing by means of the tapered bearing face. Since the face on the rubber ring confronting the bearing face is formed into a tapered shape with the same slanting angle as that of the bearing face, the inner end of the rubber ring is further restrained from separating from the one housing. Also, the confronting face of the rubber ring can bring about close contact with the bearing face without causing any elastic deformation.

According to the present invention, it is possible to prevent the rubber ring from moving in the coupling direction, since the inner end of the rubber ring compressed in the coupling direction is restrained from being elastically deformed to separate from the one housing.

The prevention of displacement of the rubber ring can be enhanced, since the inner end of the rubber ring is greatly restrained from separating from the one housing. Also, since the confronting face of the rubber ring can make a close contact with the bearing face without generating the elastic deformation and the inner end of the rubber ring is not required for elastic deformation, it is possible to prevent deterioration of sealing in the inner end of the rubber ring caused by the elastic deformation.

DETAILED DESCRIPTION OF THE PREFERRED EMBODIMENTS

Figure 1:
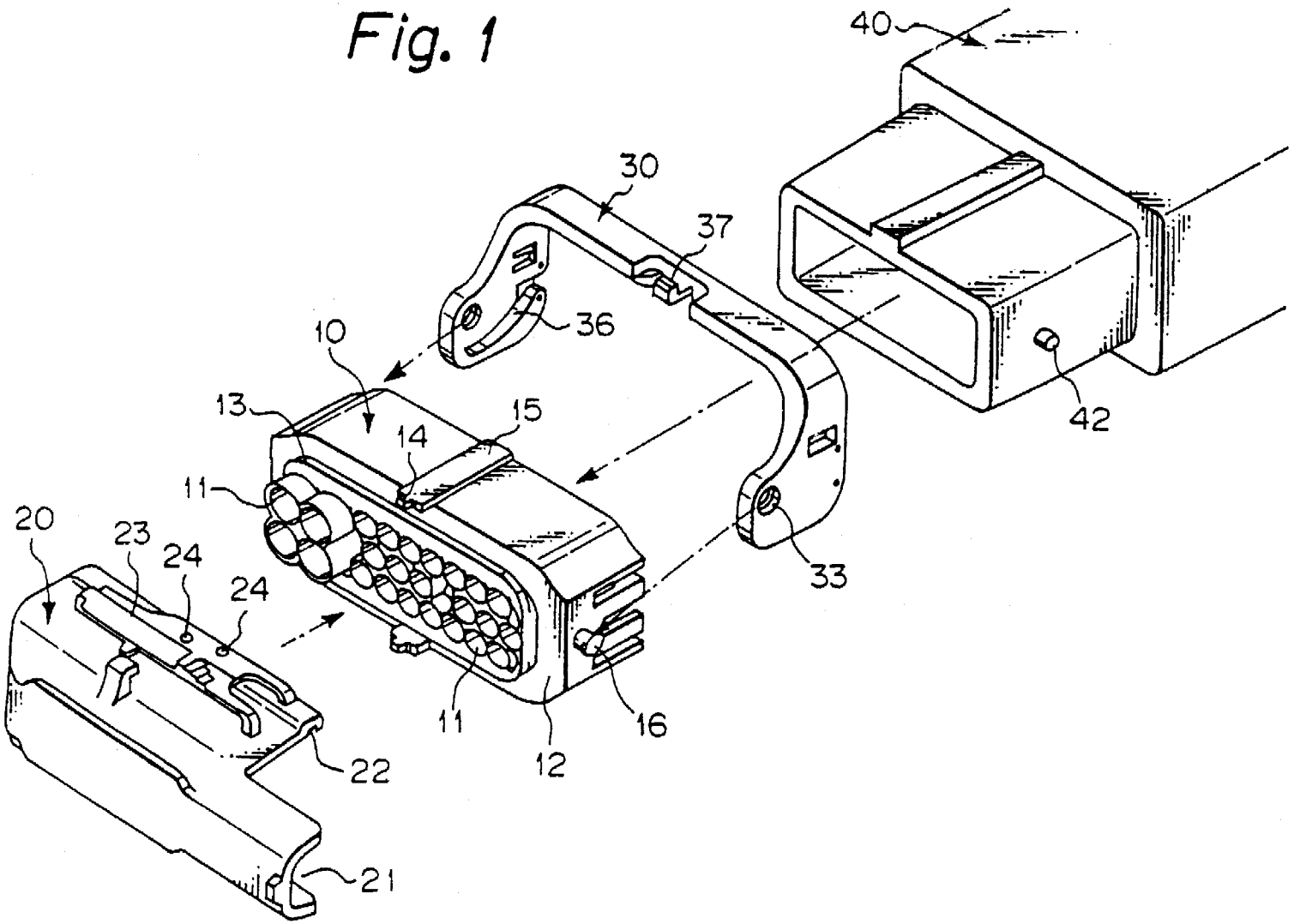
FIG. 1 is an exploded perspective view of an embodiment of a lever type connector in accordance with the present invention.

Referring now to FIGS. 1 through 11, an embodiment of a lever type connector of the present invention will be explained below.

A lever type connector of this embodiment comprises a female housing 10 adapted to be coupled to a mating male housing 40, a cover 20, and a lever 30 which is mounted on the female housing 10 to serve to interconnect both housings 10 and 40.

Figure 11:
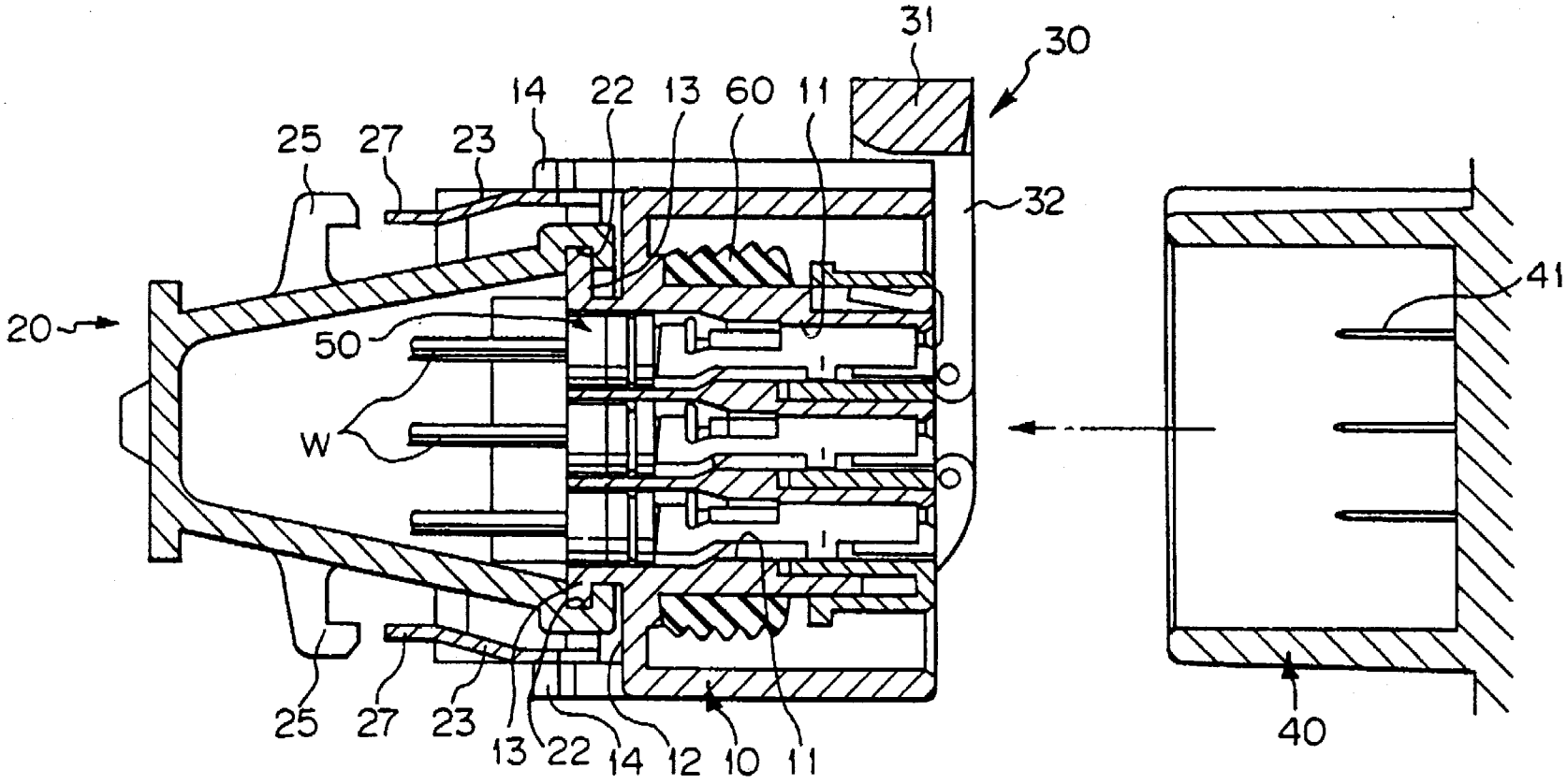
FIG. 11 is a longitudinal sectional view of the lever type connector in which a cover is mounted on the female housing.

The female housing 10 is provided with a plurality of cavities 11 which are open at the front and rear sides of the housing 10 and are disposed therein in a given arrangement. As shown in FIG. 11, a female terminal 50 is received in each cavity 11. An electric wire W connected to each female terminal 50 is drawn out of a rear side surface (hereinafter referred to as a wire-drawing surface) 12. The electric wire W is bent in the interior of the cover 20, which is mounted on the wire-drawing surface 12, and is drawn longitudinally along the wire-drawing surface 12 out of a wire outlet 21. The female housing 10 is provided on the wire-drawing surface 12 with a pair of guides 13, 13, which serve to guide the cover 20 upon the attachment and detachment of the cover 20, and is further provided at the longitudinal center position with a pair of upper and lower lock pieces 14, 14 which serve to hold the cover at a regular mounting position (hereinafter referred to as a locked position).

One of the pair of upper and lower lock pieces 14, 14 extends from a ridge 15 which propjets from the outer surface of the female housing 10. The ridge 15 serves as a positioning means which can prevent the female housing 10 from being coupled to the male housing 40 reversely.

The cover 20 is greatly open at the side opposed to the wire-drawing surface 12. The cover 20 is provided in a longitudinal end thereof with the wire outlet 21 which is contiguous to the opening. The cover is also provided in an open side end edge opposed to the surface 12 with a pair of upper and lower fitting grooves 22, 22 adapted to be fitted to the guides 13, 13. The cover 20 is mounted on the female housing 10 by coupling the fitting grooves 22 to the guides 13 from the side of the wire outlet 21 and by sliding the cover 20 along the wire-drawing surface 12 and the cover 20 is detached from the female housing 10 by sliding the cover 20. As described in detail hereinafter, since the guides 13 are arranged symmetrically with respective to the lateral axis, the cover 20 can be selectively mounted on the female housing 10 so that the wire outlet 21 is directed to the reversed direction.

The cover 20 is provided on the opposite side surface with a pair of upper and lower flexible pieces 23, 23 each of which has holding protrusions 24, 24 spaced longitudinally and is formed into a bridge-like configuration. As mentioned after in detail, one of the holding protrusions 24 engages with the lock piece 14 so as to maintain the cover 20 in the locked position when the cover 20 is disposed in the locked position and the cover 20 is maintained in the unlocked position shifted slightly from the locked position when the lock piece 14 is disposed between the holding protrusions 24 and 24. The cover 20 is released from the locked position or the unlocked position by elastically deforming the flexible piece 23. When the cover 20 is mounted on the female housing 10, the holding protrusion 24 engages with the lock piece 14 at the slanting face thereof so that the protrusion 24 escapes from the piece 23 while deflecting the piece 23. Consequently, the holding protrusion 24 does not interrupt the cover 20 on its way to the locked position.

The cover 20 is provided on opposite sides with a pair of upper and lower lock pawls 25, 25 which are adapted to engage with a lock pawl 37 on the lever 30. Each lock pawl 25 is disposed at a middle position between a pair of right and left support axles 16 and 16 and both lock pawls 25 and 25 are disposed on upper and lower walls of the cover 20 in symmetry with the coupling directional line perpendicular to the axis of the support axles 16. Accordingly, the lock pawls 37 and 25 can interlock with each other regardless of in which direction the wire outlet 21 in the cover 20 is directed.

The female housing 10 is provided on opposite longitudinal end surfaces with a pair of right and left support axles 16 and 16 which project coaxially to support the lever 30. The axis of the support axles 16, 16 is perpendicular to the coupling direction between the mating male housing 40 and the female housing 10. The support axles 16 and arranged on opposite end surfaces on the female housing 10.

When the male terminals 41 (FIG. 11) are coupled to the female terminals 50 (FIG. 11), a tab (not shown) on the male terminal 41 is elastically clamped between elastic contact pieces (not shown) provided in the interior of the female terminal 50. Consequently, moments around the support axles 16 are generated between the male housing 40 and the female housing 10 by coupling resistances due to contact pressures between the male and female terminals 41 and 50.

This moments depend on various conditions such as a position in which the tabs are clamped in the female terminals 50, an arrangement of the female terminals 50, and clamping pressures of the flexible contact pieces of different terminals. Thus, in this embodiment, the position of the support axles 16 is set relative to the arrangement of the terminals 50 so that the terminals 50 are provided on both sides of the axis of the support axles 16 and the moments generated by the coupling resistances between the terminals on one side are balanced with the moments generated by the coupling resistances between the terminals on the other side.

Accordingly, since the support axles 16 are positioned so as to balance the moments, no moment around the axles 16 is generated between the housings 40 and 10 when the female housing 10 is coupled to the male housing 40, thereby displacing both housings 10 and 40 coaxially.

Figure 3:
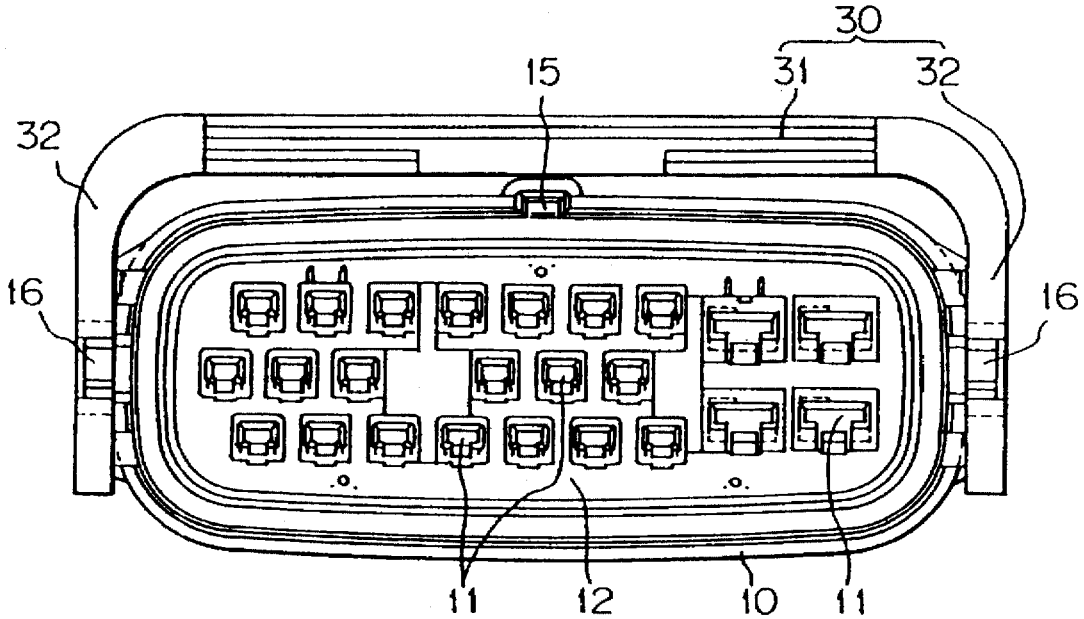
FIG. 3 is a front elevational view seen by an arrow in FIG. 2, illustrating a state in which the lever is attached to the female housing.

In FIG. 3, the axis of the support axles 16 is set on a little higher than half a height of the female housing 10 (exclusive of the height of the ridge 15) with respect to the bottom surface thereof, provided a distance from the center line of the uppermost cavities 11 to the upper surface of the housing 10 is equal to a distance from the center line of the lowermost cavities 11 to the bottom surface of the housing 10. Thus, this embodiment can set the center of the female housing in height (including the height of the ridge 15) to be on the axis of the axles 16 by utilizing a difference in distance between the positions of the axis of the axles 16 and the center in height of the female housing 10 and by providing the ridge 15 on the upper surface of the housing 10.

Figure 4:
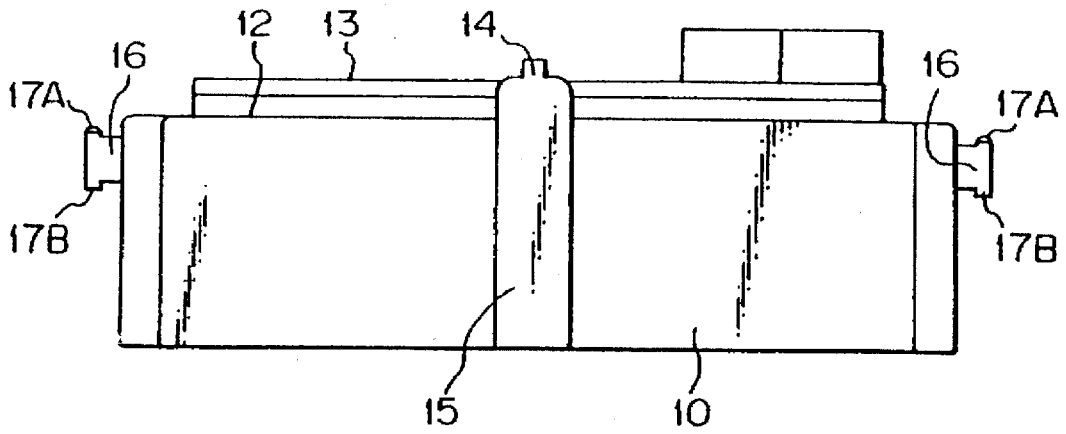
FIG. 4 is a plan view of the female housing from which the lever is removed.
Figure 8:
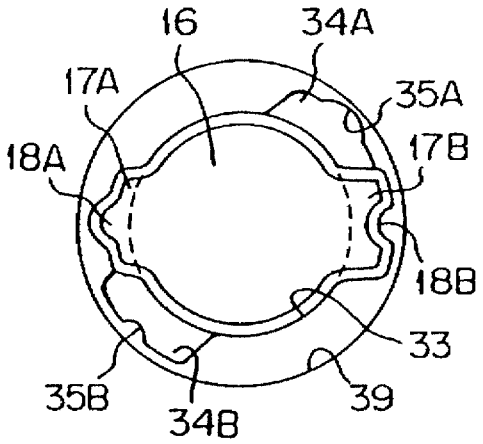
FIG. 8 is a fragmentary enlarged side elevational view of a bearing hole in which a support axle is inserted when the lever is in the releasing position.

As shown in FIG. 4, each support axle 16 is provided on its distal end with a pair of diametrically enlarged portions 17A and 17B. The enlarged portions 17A and 17B are spaced from each other by an angle of 180° in the circumferential direction of the support axle 16 and are directed to the coupling direction of both housings 10 and 40. The enlarged portions are formed into symmetrical shapes with respect to the diameter of the support axle 16. Moreover, as shown in FIG. 8, the shapes of the enlarged portion 17A and 17B are different from each other. In other words, one enlarged portion 17A is provided on its outer periphery with a convex part 18A while the other enlarged portion 17B is provided on its outer periphery with a concave part 18B. The enlarged portions 17A and 17B are adapted to engage with leg portions 32 on the lever 30, thereby preventing the lever 30 from coming out of the female housing 10.

Figure 5:
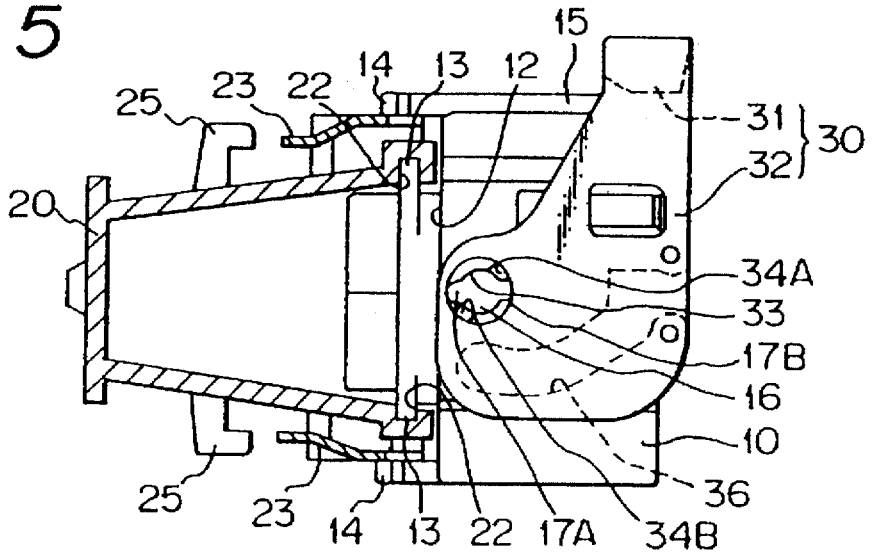
FIG. 5 is a partially broken-away side elevational view of the lever type connector in which the lever is disposed in a releasing position.
Figure 6:
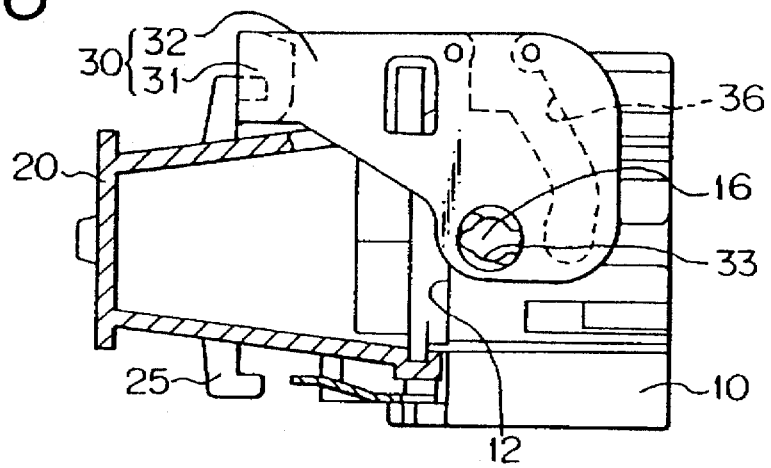
FIG. 6 is a partially broken-away side elevational view of the lever type connector in which the lever is disposed in a fitting position.

As shown in FIGS. 3 and 5, the lever 30 is generally a U-shaped configuration having an operational handle 31 extending in a longitudinal direction of the female housing 10 and a pair of plate-like leg portions 32, 32 each of which is connected to each end of the handle 31. The leg portions 32, 32 are provided with a pair of coaxial bearing holes 33, 33. The bearing holes 33, 33 rotatably receive the support axles 16, thereby rotatably supporting the lever 30 on the female housing 10.

The lever 30 can be turned between a fitting-release position (FIG. 5) in which the handle 31 is opposed to a front side of the female housing 10 and a fitting position (FIG. 6) in which the handle 31 is turned by an angle of 90° from the fitting-release position to oppose the wire-drawing surface 12. When the lever 30 is in the fitting-release position, cam grooves 36 in the inner surfaces of the leg portions 32, 32 engage with bosses 42 on the male housing 40, and the lever 30 is turned, the male housing 40 is pulled towards the female housing 10. When the lever 30 reaches the fitting-position, coupling of both housings 10 and 40 is complete. When the lever 30 is turned from the fitting position to the fitting-release position, the male housing 40 is disconnected from the female housing 10 by engagement between the cam grooves 36 and bosses 42.

Figure 2:
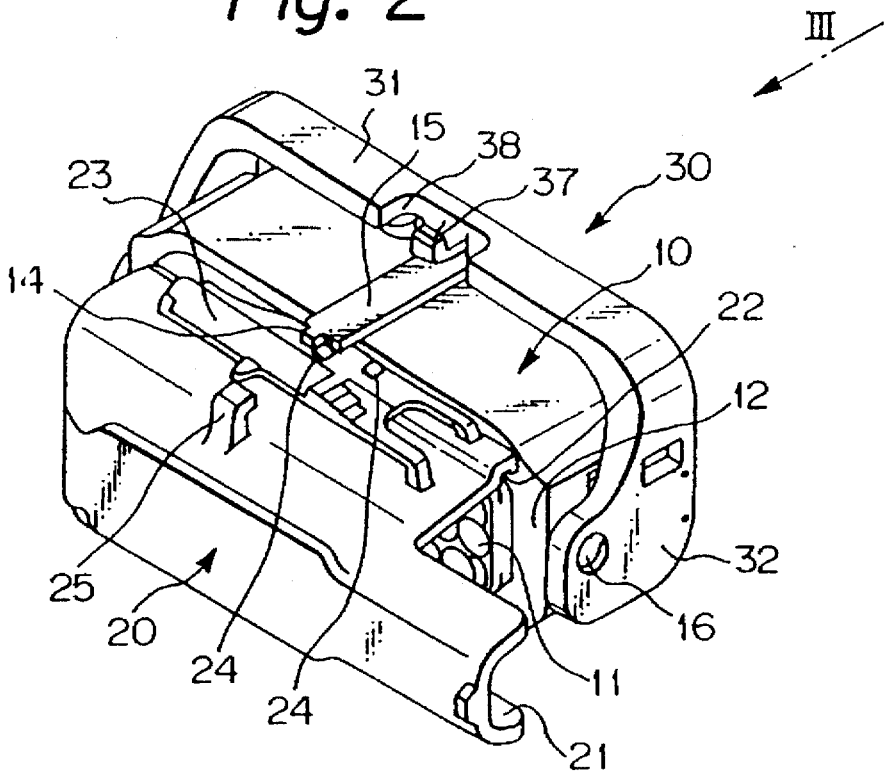
FIG. 2 is a perspective view of a female housing to which a lever is attached.

As shown in FIGS. 2 to 4, the handle 31 of the lever 30 is provided on its longitudinal center with a lock pawl 37 adapted to engage with a lock pawl 25 on the cover 20. When the lever 30 reaches the fitting position, the lock pawls 37 and 25 elastically engage with each other, thereby preventing the lever 30 from moving to the fitting-release position. When the cover 20 is displaced to the unlocked position, the lock pawl 25 is unlocked from the lock pawl 37 and deflected down in an escape slot 38. In this position, the lever 30 is unlocked to be allowed to turn to the fitting-release position.

Figure 9:
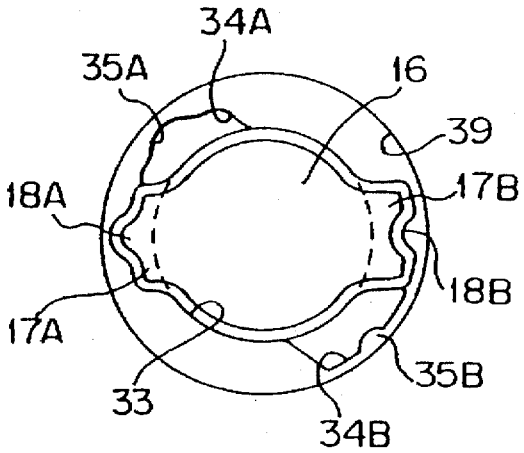
FIG. 9 is a fragmentary enlarged side elevational view of the bearing hole in which the support axle is inserted when the lever is in the fitting position.

As shown in FIGS. 8 and 9, the bearing hole 33 is provided with locking mechanism 18 (see FIGS. 14 and 15) comprising a pair of recesses 34A and 34B which are adapted to be fitted to the enlarged portions 17A and 17B of the support axle 16. One recess 34A is provided in its inner periphery with a concave part 35A while the other recess 34B is provided in its inner periphery with a convex part 35B. The enlarged portion 17A with the convex part 18A is received in the recess 34A with the concave part 35A and at the same time the enlarged portion 17B with the concave part 18B is received in the recess 34B with the convex part 35B.

In the case where the pair of enlarged portions 17A and 17B are received in the pair of recesses 34A and 34B, the handle 31 of the lever 30 projects greatly on the side of the wire-drawing surface 12. In this posture of the lever 30, it turns by an angle of 135° in the fitting-release direction from the fitting position shown in FIG. 5. That is, the lever 30 greatly turns over a rotary range of 90° from the fitting position of both housings 10 and 40.

Figure 7:
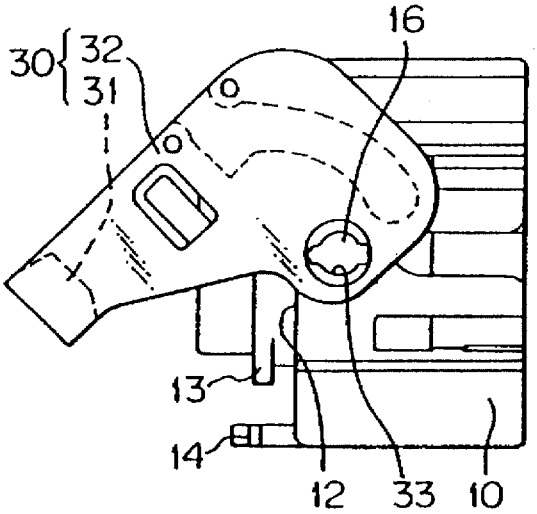
FIG. 7 is a side elevational view of the lever type connector in which the lever is disposed in a position to be mounted on the female housing.

Accordingly, when the enlarged portions 17A and 17B are received in the recesses 34A and 34B by turning the lever 30 to the position shown in FIG. 7, the lever 30 can be detached from the support axles 16. Once the lever 30 is mounted on the female housing 10, the enlarged portions 17A and 17B are not aligned with the recesses 34A and 34B so long as the lever 30 turns within the ordinary rotary range.

Since the enlarged portions 17A and 17B of the support axles 16 are disposed symmetrically with respect to the axis of the coupling direction, it is possible to mount the lever 30 on the female housing 10 in either one of two postures (shown in FIGS. 5 and 15) in the coupling combination between the support axles 16, 16 and the bearing holes 33, 33. In addition, the lever 30 generates two rotary loci symmetrically with the axis of the fitting direction in the two mounting postures. Since the enlarged portions 17A and 17B are different in their shapes, it is possible to restrain the lever 30 from being mounted on the female housing 10 in an incorrect posture in which the handle 31 of the lever 30 shown in FIG. 7 is disposed on the right side from the female housing 10.

Moreover, the leg portion 32 is provided in its outer surface with a circular containing recess 39 coaxial with the bearing hole 33. The recesses 34A and 34B are formed in the containing depression 39 which is depressed by the same depth as the thickness of the enlarged portions 17A and 17B, so that the portions 17A and 17B do not project from the outer side surface on the leg portion 32 when the support axle 16 enters the bearing hole 33.

Next, an operation of this embodiment will be explained below.

Figure 10:
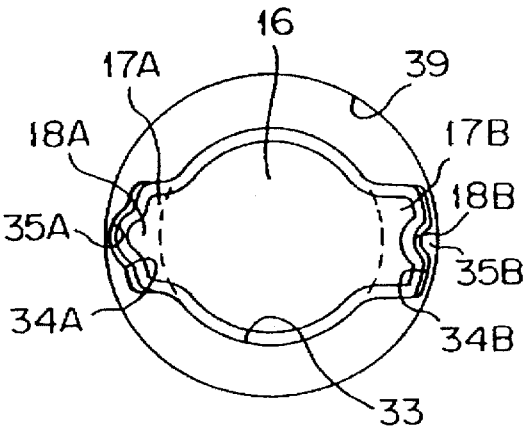
FIG. 10 is a fragmentary enlarged side elevational view of the bearing hole in which the support axle is inserted when the lever is in a position to be mounted on the female housing.

When the lever 30 is mounted on the female housing 10, the cover 20 is removed from the female housing 10. The lever 30 can be mounted on the support axles 16 on the female housing 10 by bringing the lever 30 into the posture shown in FIG. 7 and by aligning the enlarged portions 17A and 17B in the recesses 34A and 34B as shown in FIG. 10 while elastically widening the distance between both leg portions 32. Then, after the lever 30 is turned to the fitting-releasing position shown in FIG. 5, the cover 20 is mounted on the female housing 10. Thus, the mounting operation of the lever 30 and cover 20 on the female housing 10 is finished.

The female housing 10 is coupled to the male housing 40 by turning the lever 30 from the above position to the fitting position. When the lever 30 reaches the fitting position, the lock pawl 25 engages with the lock pawl 37 to lock the lever 30, thereby locking the male and female housings 40 and 10 in the fitting position.

Since the lever 30 is disposed in the position in which the moments caused by the coupling operation are balanced, there is no interference between the male and female housings 40 and 10 during the coupling operation, thereby enhancing a smooth coupling operation.

Since the enlarged portions 17A and 17B engage with the outer side surface on the leg portions 32, 32, although the leg portions 32, 32 receive the pressure forces which push the portions 32, 32 outwardly, the leg portions 32, 32 are prevented from coming out of the support axles 16. In addition, such a preventing function is greatly enhanced since the enlarged portions 17A and 17B are spaced away by an angle of 180° on each support axle 16.

In the case of disconnecting both housings 40 and 10, when the flexible piece 23 of the cover 20 is manually elastically deformed, the holding protrusion 24 is disengaged from the lock piece 14, so that the cover 20 is unlocked from the locked position on the female housing 10. Then, the cover 20 is slid to the unlocking position. The lock pawl 25 is disengaged from the lock pawl 37 to unlock the lever 30.

Thereafter, the female housing 10 is disconnected from the male housing 40 by turning the lever 30 to the unlocking position. Since the moments around the support axles 16 caused by the frictional resistance between the male terminals 41 and the female terminals 50 are balanced in the same manner as the coupling operation, there is no interference between the male housing 40 and the female housing 10 during the detaching operation. Accordingly, the detaching operation can be smoothly effected.

In the case of changing the mounting posture of the lever 30, the cover 20 is removed from the female housing 10 and then the lever 30 is removed from the female housing 10. At this time, the lever 30 is turned to the position shown in FIG. 7 to align the recesses 34A and 34B with the enlarged portions 17A and 17B. Then, the bearing holes 33, 33 are disengaged from the support axles by elastically widening the distance between both leg portions 32 and 32. The lever 30 thus removed from the housing 10 is reversed from a posture shown in FIG. 14 to a posture shown in FIG. 15. Then, the lever 30 is mounted on the female housing 10 in the same steps as those described above. After mounting the lever 30 on the housing 10, the cover 20 can be mounted on the female housing 10.

According to this embodiment of the lever type connector, it is possible to easily operate the lever 30, for example, in the case of attaching the lever type connector in a small space by selecting a mounting manner of the lever 30 in accordance with the attaching condition, since the lever 30 can be mounted on the female housing 10 in the different two postures.

Since the position of the support axle is determined in view of the moments around the support axles 16 caused by the coupling resistances between the male and female housings 40 and 10, there is no interference between both housings and the lever 30 can be smoothly operated even if the lever 30 is mounted on the female housing 10 in either posture.

In this embodiment, there is no idle clearance between the handle 31 of the lever 30 and the female housing 10 in either posture of the lever 30, since the position of the axis of the support axles 16, which is set to balance the moments due to the coupling resistances, accords with a center in height of the female housing 10 including the ridge 15 for preventing the reverse coupling. Accordingly, it is possible to make the female housing 10 compact.

It will be understood that the present invention is not limited to the embodiment described above. The present invention may be modified to the following various alterations within the scope of the spirit of the present invention:

(1) The present invention may be applied to the case where the lever is turned across the cover, although the lever 30 is turned on the side from the cover 30 in the above embodiment.

(2) The pair of enlarged portions may be the same in shape so long as the lever is mounted on the housing in the corrective direction, although the pair of enlarged portions 17A and 17B are different in shape in the above embodiment.

(3) A single enlarged portion may be provided on the support axle, although two enlarged portions 17A and 17B are provided on the support axle 16 in the above embodiment.

Next, another embodiment of the lever type connector in accordance with the present invention will be explained below by referring mainly to FIGS. 11 to 15.

The connector in this embodiment comprises a male housing 40, a female housing 10 to be coupled to the male housing 40, a lever 30 which serves to interconnect the male and female housings 40 and 10, and a cover 20 which serves to bundle electric wires W extending from the female housing 10 and to take out the wires W in a given direction.

The female housing 10 has an elongate front face (see FIG. 3) which becomes a fitting face for the male housing 40. The female housing 10 is provided on its longitudinal opposite end faces with support axles 16, 16 aligned coaxially and adapted to support the lever 30. Each support axle is provided on its distal end with enlarged portions which prevent the lever from coming out of the support axle 16.

The female housing 10 is provided with a plurality of cavities 11 which are open at their front and rear faces and into each of which cavities a terminal 50 connected at its rear end to the electric wire W is inserted through the rear face. Since the electric wire W extends outwardly from the rear face of the female housing 10, the rear face of the housing 10 is referred to as "a wire-drawing surface" hereinafter.

A pair of guides 13, 13 are provided on the wire-drawing surface in order to guide the cover 20 upon attaching and detaching it. The pair of guides 13, 13 extend outwardly from opposite side edges of an arranging area of the wires W on the wire-drawing surface 12 and extend longitudinally along the side edge of the arranging area. The guides 13, 13 are disposed symmetrically with respect to a longitudinal direction of the arranging area of the wire W (the wire-drawing direction from the wire outlet 21) and each guide is formed symmetrically with respect to a longitudinal axis (the housing-coupling direction).

The female housing 10 is provided on its upper and lower surfaces with an engaging piece 14 which projects from the wire-drawing surface 12 so as to maintain the cover 20 at the regular mounting position. Each engaging piece 14 is disposed in a position corresponding to a longitudinal center of the guide 13 and spaced away from the guide 13 by a given distance. The engaging pieces 14, 14 are disposed symmetrically with respect to the wire-drawing direction in the same manner as the guides 13, 13.

The lever 30 includes a pair of leg portions 32, 32 and an operational handle 31 which interconnects the pair of leg portions to form a generally U-shaped configuration. A bearing hole 33 in each leg portion 32 receives the support axle 16 on the female housing 10 rotatably. The bearing hole 33 is provided with recesses 34A and 34B (see FIG. 8) which are complementary shapes for the enlarged portions 17A and 17B on the support axle 16. The support axle 16 can be detached from the bearing hole 33 by aligning the enlarged portions 17A and 17B with the recesses 34A and 34B. Accordingly, the lever 30 can adopt two attaching postures relative to the female housing 10, namely the postures shown in FIGS. 14 and 15.

The lever 30 can be turned between a fitting-release position (FIG. 5) in which the handle 31 is opposed to a front side of the female housing 10 and a fitting position (FIG. 6) in which the handle 31 is turned by an angle of 90° from the fitting-release position to oppose the wire-drawing surface 12. When the lever 30 is turned from the fitting-release position to the fitting position, with cam grooves 36 in the inner surfaces of the leg portions 32, 32 engaging with bosses 42 on the male housing 40, the male housing 40 is pulled towards the female housing 10. When the lever 30 reaches the fitting-position, coupling of the housings 10 and 40 is complete. When the lever 30 is turned from the fitting position to the fitting-release position, the male housing 40 is disconnected from the female housing 10 by engagement between the cam grooves 36 and bosses 42.

Further, the operational handle 31 of the lever 30 extends in the longitudinal direction of the female housing 10. The handle 31 is provided on its longitudinal center with a lock pawl 37 (see FIG. 1) which is able to engage with a lock pawl 25 on the cover 20 in the fitting position of the lever 30.

The cover 20 is symmetrical with respect to its longitudinal axis. The cover 20 is open at the side confronting the wire-drawing surface 12 and a wire outlet 21 is provided in a longitudinal end of the cover 20 contiguous to the opening. A U-shaped wire-leading portion 29 projects longitudinally from an end of the wire outlet 21.

The cover 20 is provided on an opening edge opposed to the wire-drawing surface 12 with a pair of fitting grooves 22 and 22 adapted to engage with the pair of guides 13 and 13. One end of the fitting groove 22 is open at the open edge of the wire outlet 21. The other end of the fitting groove 22 is closed by an inner wall of the cover 20. The closed end serves as a stopper 28 for limiting the sliding movement of the cover 20.

The cover 20 is mounted on the female housing 10 by fitting the guides 13, 13 in the fitting grooves 22, 22 on the side of the wire outlet 21 and sliding the cover on the wire-drawing surface 12. When the cover 20 reaches the regular position, the stopper 28 abuts on the end of the guides 13, thereby limiting further sliding movement of the cover 20. Then, the mounting operation of the cover is finished. If the cover 20 in the regular position is slid on the female housing 10 in the reverse direction, the cover 20 can be removed from the female housing 10.

The regular position in which the cover 20 is mounted on the female housing 10 regularly is hereinafter referred to as a locked position of the cover 20 (see FIG. 13) and a position in which the cover 20 is slightly moved from the locked position is hereinafter referred to as an unlocked position of the cover 20 (not shown).

The cover 20 is provided on opposite sides with a pair of upper and lower lock pawls 25, 25 adapted to engage with the lock pawl 37 on the lever 30 when the cover 20 is in the locked position. When the lever 30 reaches the fitting position, the lock pawls 37 and 25 engage with each other while they are elastically deflected, thereby restraining the lever 30 from turning to a fitting-releasing direction. Since the operational handle 31 comes into close contact with the cover 20 in the above state, the handle 31 is not likely to be accidentally moved to turn the lever 30 to the fitting-releasing direction. When the cover 20 is moved from the locked position to the unlocked position, the lock pawl 25 disengages from the lock pawl 37 and moves into an escape slot 38 (see FIG. 2). In this state, the lever 30 is able to turn to the fitting-releasing direction.

The cover 20 is provided on the opposite sides with a pair of upper and lower bridge-like flexible pieces 23, 23 which extend in the longitudinal direction of the female housing 10 and are supported on the cover 20 at their opposite ends. The flexible pieces 23 are not symmetrical with respect to the lateral axis but are symmetrical with respect to the longitudinal axis.

The flexible piece 23 is provided with two holding projections 24 and 24 which are arranged longitudinally to engage with the engaging piece 14 on the female housing 10 and have a slanting face on one side thereof. One of the holding projections 24, 24 engages with the engaging piece 14 when the cover 20 is in the locked position, thereby maintaining the cover 20 in the locked position. When the cover 20 is in the unlocked position, holding projections 24, 24 engage with opposite sides of the engaging piece 14, thereby maintaining the cover 20 in an unlocked position. The state of the cover 20 being in a locked position or unlocked position is changed by elastically deflecting the flexible piece 23. Upon mounting the cover 20 on the female housing 10, the flexible piece 23 is elastically deflected by riding the engaging portion 14 on the slanting face of the holding projection 24, so that the engaging projection 24 does not interfere with attachment of the cover 20.

The flexible piece 23 is also provided with a push finger 27 which serves to turn the lever 30 to the fitting-releasing direction. The push finger 27 is disposed adjacent to the lock pawl 25. When the cover 20 is in the locked position, the push finger 27 is opposed to the escape slot 38 in the lever 30. When the cover 20 is moved to the unlocked position while elastically deflecting the flexible piece 23 and the push finger 27 to approach the cover 20, the push finger 27 enters a recess (not shown) contiguous to the scape slot 38 and the push finger 27 can apply a biasing force in the fitting-releasing position caused by an elastic recovery force of the flexible piece 23 to the operational handle 31 of the lever 30.

Figure 16:
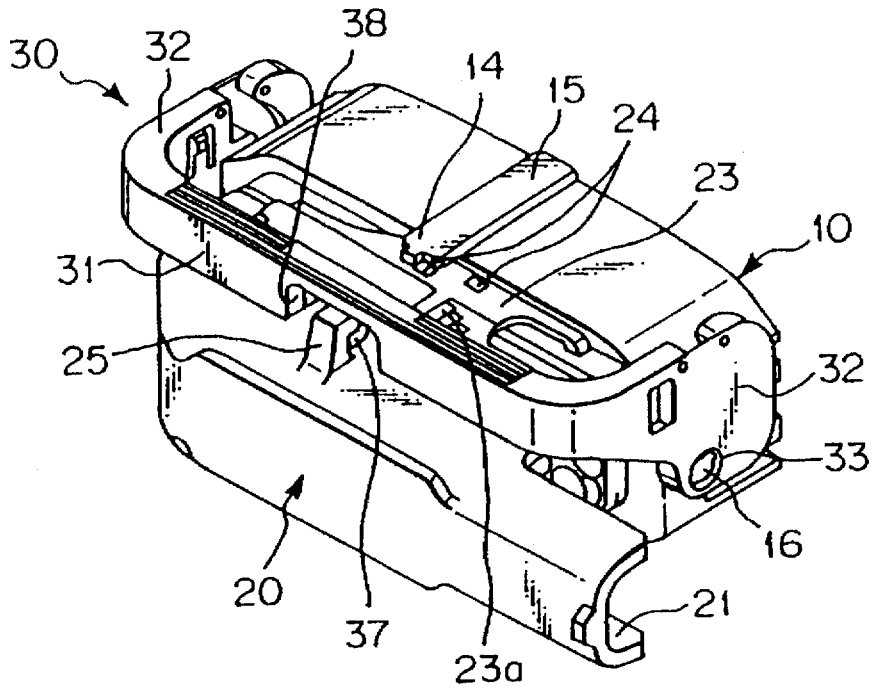
FIG. 16 is a perspective view of the lever type connector in which the lever is locked in the fitting position.
Figure 17:
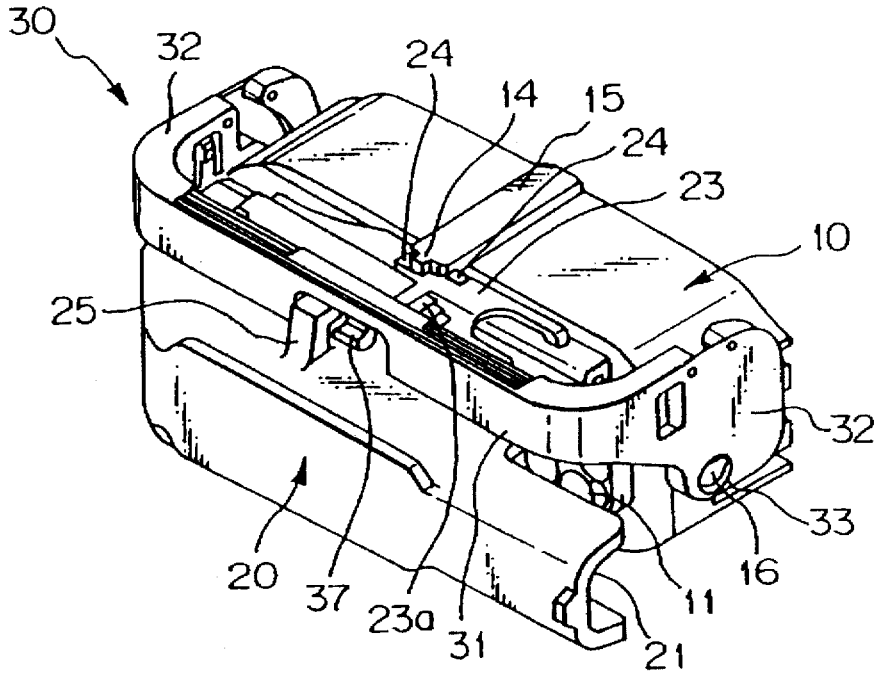
FIG. 17 is a perspective view of the lever type connector in which the lever is unlocked from the fitting position.
Figure 18:
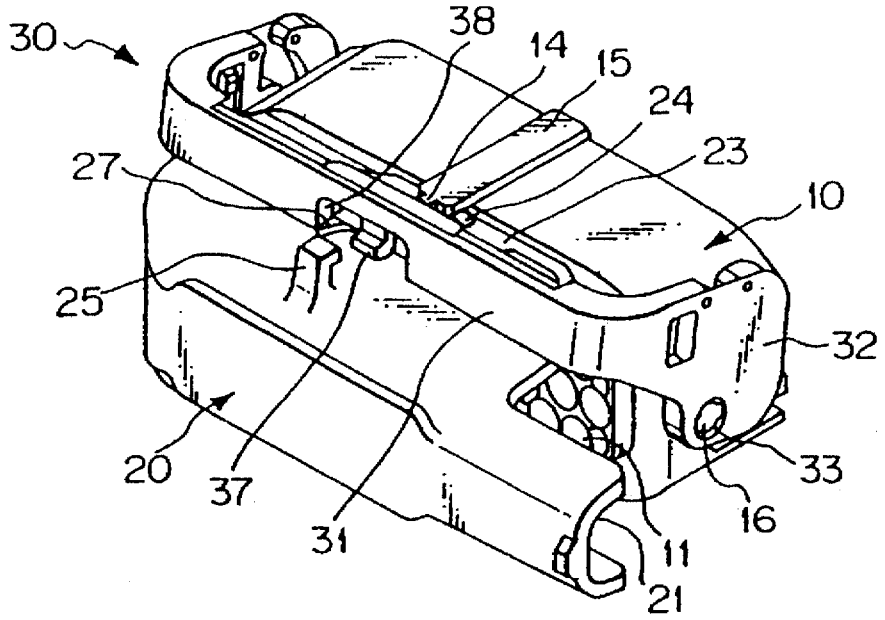
FIG. 18 is a perspective view of the lever type connector in which an operational handle of the lever is displaced upwardly from the housing.
Figure 19:
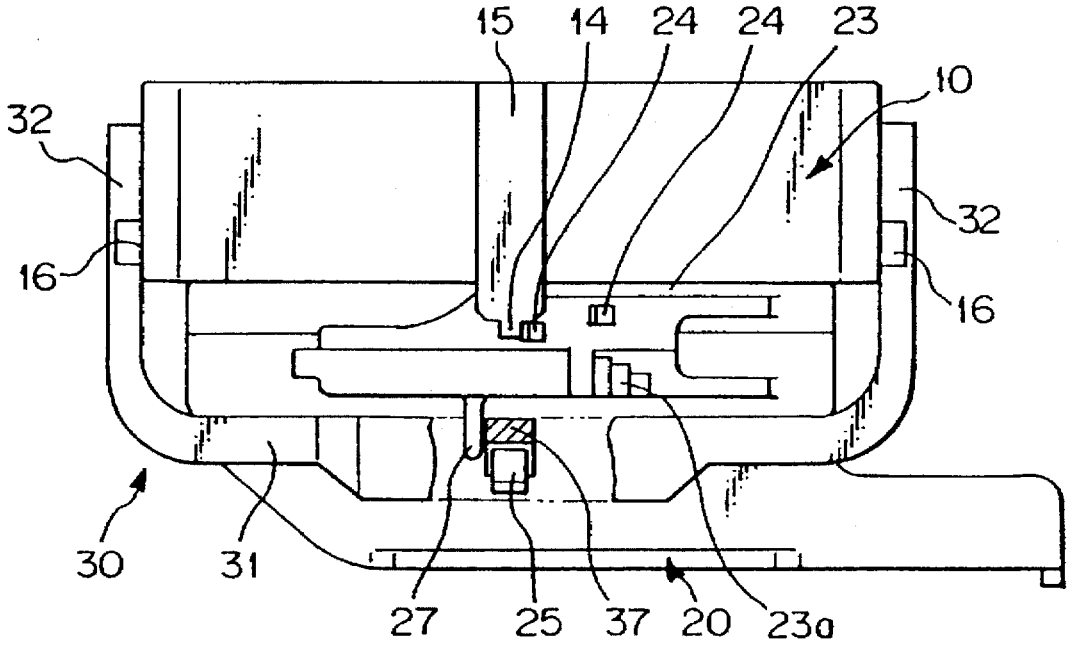
FIG. 19 is a plan view of the lever type connector in which the lever is locked in the fitting position.
Figure 20:
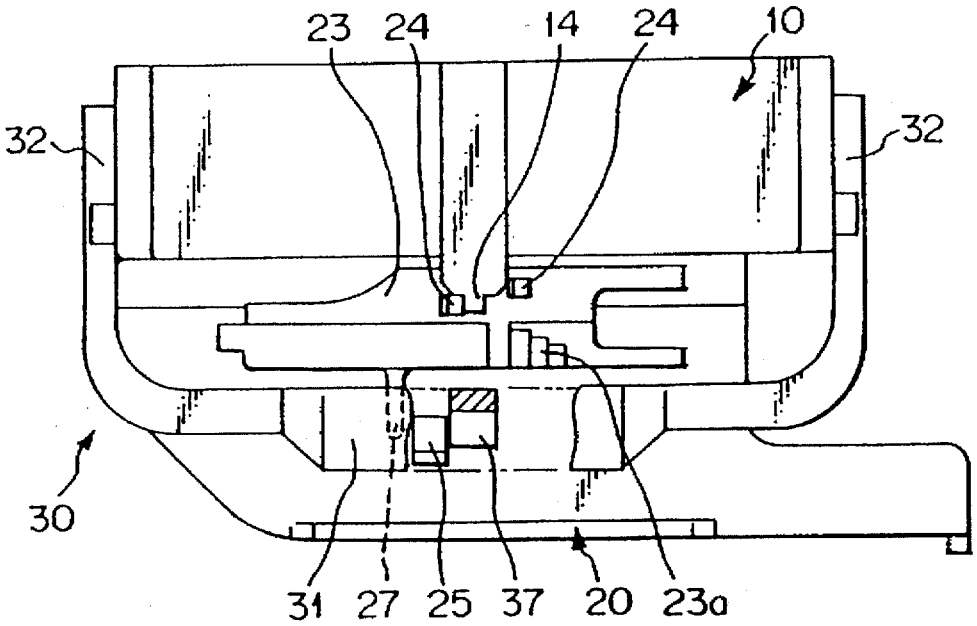
FIG. 20 is a plan view of the lever type connector in which the lever is unlocked from the fitting position.
Figure 21:
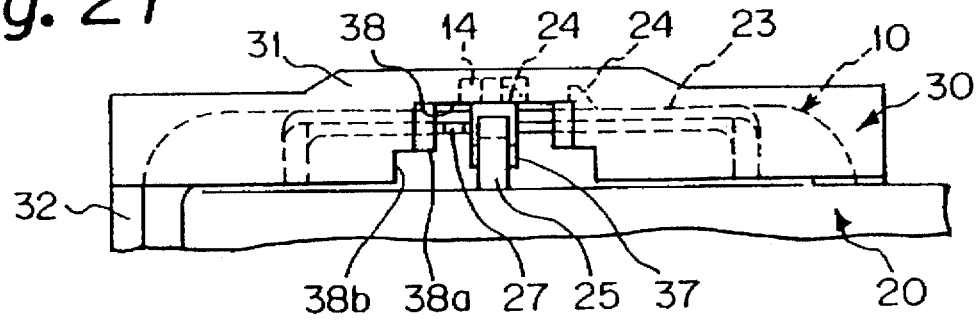
FIG. 21 is a fragmentary front elevational view of the lever type connector in which the lever is locked in the fitting position.
Figure 22:
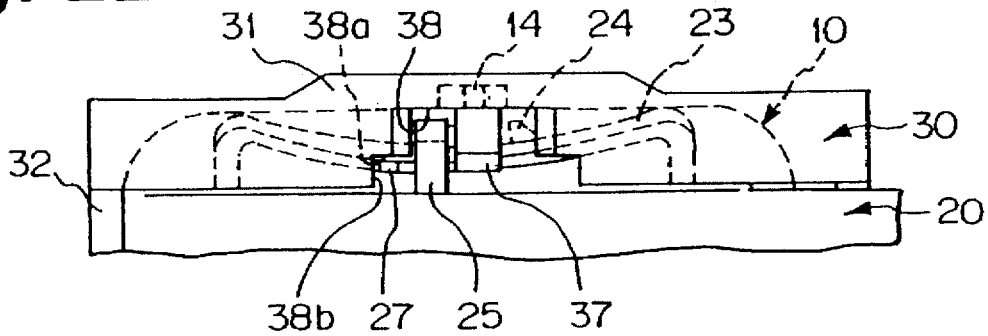
FIG. 22 is a fragmentary front elevational view of the lever type connector in which the lever is unlocked from the fitting position.
Figure 23:
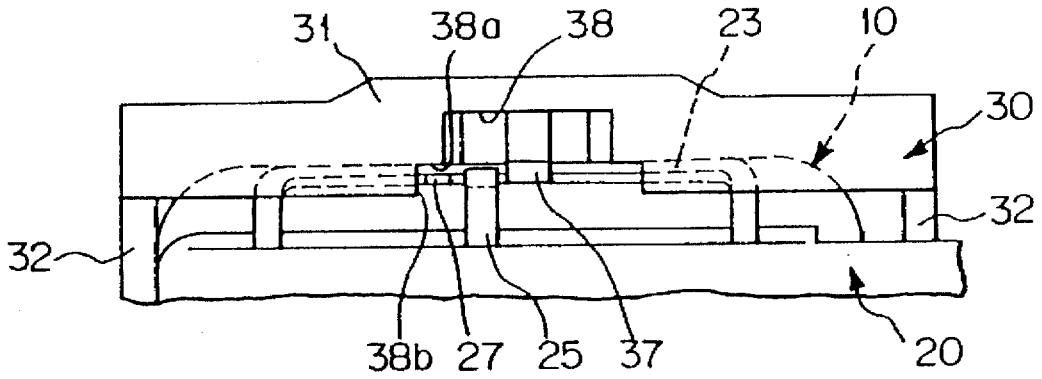
FIG. 23 is a fragmentary front elevational view of the lever type connector in which the operational handle of the lever is displaced upwardly from the housing.

Moreover, the flexible piece 23 is provided with a stepped button 23*a* (see FIG. 16). When the stepped button 23*a* is pushed down and laterally, a pushing force for elastically deforming the flexible piece 23 and sliding the cover 20 from the locked position to the unlocked position can be obtained at the same time.

Next, an operation of this embodiment will be explained below.

The assembling process of the connector of this embodiment is carried out by the following steps. The lever 30 is mounted on the female housing 10 beforehand and the female terminals 50 are contained in the cavities 11 beforehand. The cover 20 is mounted on the female housing 10.

The attachment of the cover 20 is carried out by fitting the guides 13, 13 on the female housing 10 in the fitting grooves 22, 22 in the cover 20 and sliding the cover 20 on the housing 10 towards the wire outlet 21. A plurality of electric wires W extending from the wire-drawing surface 12 are contained in the cover 20 and naturally bent to the wire outlet 21 while sliding the cover 20 on the housing 10. At this time, since there is scarcely any clearance between the cover 20 and the wire-drawing surface 12 in comparison with a case where the cover 20 is approached towards the surface 12, the wires W is not clamped between the cover 20 and the wire-drawing surface 12 and does not come out of the cover 20 laterally. After the cover 20 is completely mounted on the housing 10, the wires W extend together outwardly through the wire outlet 21.

Figure 12:
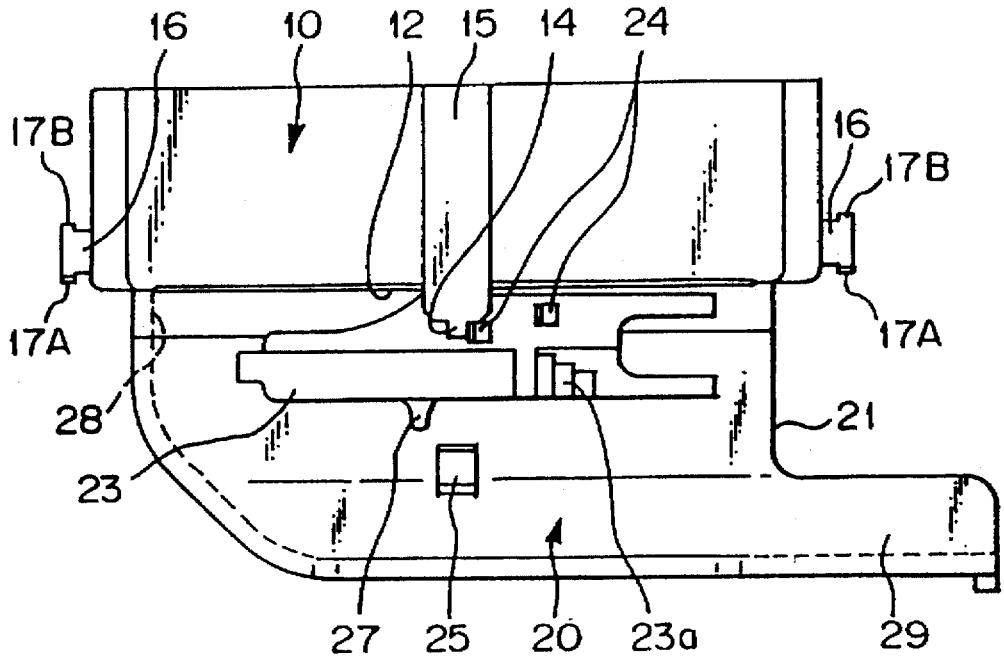
FIG. 12 is a plan view of the lever type connector in which the cover is mounted on the female housing.
Figure 13:
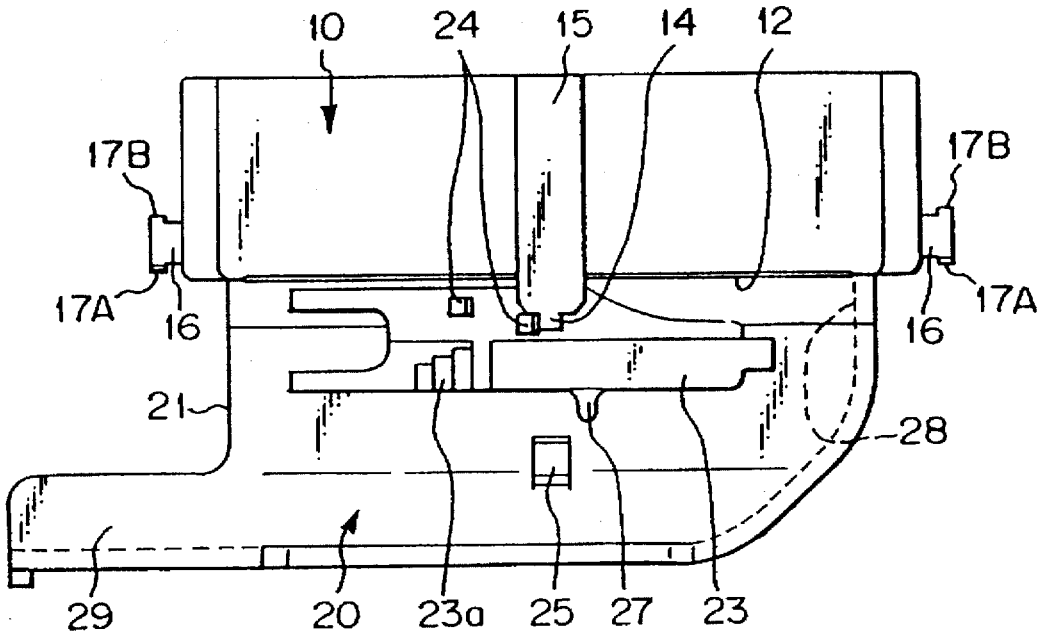
FIG. 13 is a plan view of the lever type connector in which the cover is mounted in a reversed direction to that shown in FIG. 12 on the female housing.

Since the guide 13 is symmetrical with respect to the longitudinal axis, the cover 20 can be mounted on the female housing 10 so that the wire outlet 21 is directed in one of two opposite postures (FIGS. 12 and 13). Since the engaging piece 14 is disposed at a longitudinal center on the female housing 10, the engaging piece 14 can engage with the holding projection 24 even if the lever 30 is mounted on the housing 10 in either direction, thereby enabling the cover 20 to be maintained in the locked position.

Since the lock pawls 25 are disposed at the longitudinal center on the cover 20, either lock pawl 25 can be ready to engage with the lock pawl 37 on the lever 30, even if the cover 20 is mounted on the housing 10 in either direction. Accordingly, if the lever 30 under this state is turned from the fitting-releasing position to the fitting position, the lock pawl 37 engages with the lock pawl 25 and the lever 30 is locked in the fitting position, thereby maintaining the male and female housings 40 and 10 in the fitting position.

If the stepped buttons 23*a*, 23*a* are pushed to clamp the cover 20 in the fitting position, the flexible pieces 23, 23 are elastically deformed to disengage the holding projection 24 from the engaging piece 14, thereby releasing the cover 20 from the locked position. When the cover 20 is slid to the unlocked position on the housing 10 under the above state, the lock pawl 25 is disengaged from the lock pawl 37 to release the lever 30 and the push finger 27 enters the space between the cover 20 and the operational handle 31 of the lever 30. When the stepped buttons 23*a*, 23*a* are released from pushing, the push finger 27 pushes the handle 31 to the fitting-releasing direction by means of the elastic recovery force in the flexible piece 23. This results in a sufficient space between the lever 30 and the cover 20 to be hooked by a worker's finger. Accordingly, it is possible to turn the lever 30 to the fitting-releasing direction to disconnect the male and female housings 40 and 10 from each other even if the handle 31 is under an invisible environment.

As described above, according to the present embodiment, it is possible to mount the cover 20 on the female housing 10 to direct the wire outlet 21 in either one of the opposite postures and to maintain the cover 20 in the locked position. Accordingly, the electric wires W extending from the wire outlet 21 in the cover 20 needs not to be further bent by suitably selecting the direction of the wire outlet 21, even if the attaching posture of the connector is restricted. This results in reduction of stress in the wires and arranging length of the wires due to causing many bending portions.

Since the cover 20 is mounted on the housing 10 by sliding to the wire exit direction, a plurality of wires W are bundled together in the cover 20. This avoids a trouble of clamping the wire W between the wire-drawing surface 12 and the cover 20 and enhances a working efficiency since the wires need not to be bundled beforehand in comparison with the case where the cover 20 is moved towards the wire-drawing surface 12 while manually bundling the wires W.

Further, it is possible to hold the cover more stably and surely than a case of holding the cover at the single side, because the cover 20 is held on the female housing 10 at the opposite sides by the engaging pieces 14, 14 disposed symmetrically with respect to the longitudinal axis (the sliding direction of the cover 20), as means for maintaining the cover 20 in the locked position.

It is also possible in the present embodiment to maintain the cover 20 in the locked position even though the holding projection 24 on the cover 20 and the flexible piece 23 are not symmetrical with respect to the longitudinal axis, because the engaging piece 14 is disposed at the longitudinal center on the female housing 10 and symmetrical with the longitudinal axis. Thus, it is possible to easily and efficiently effect the operation of displacing the cover 20 to the unlocked position so as to release the lever 30 and the operation of separating the lever 30 thus unlocked from the cover 20 so as to be hooked manually, since the flexible piece 23 is provided on the housing in unsymmetry with respect to the longitudinal axis.

Figure 14:
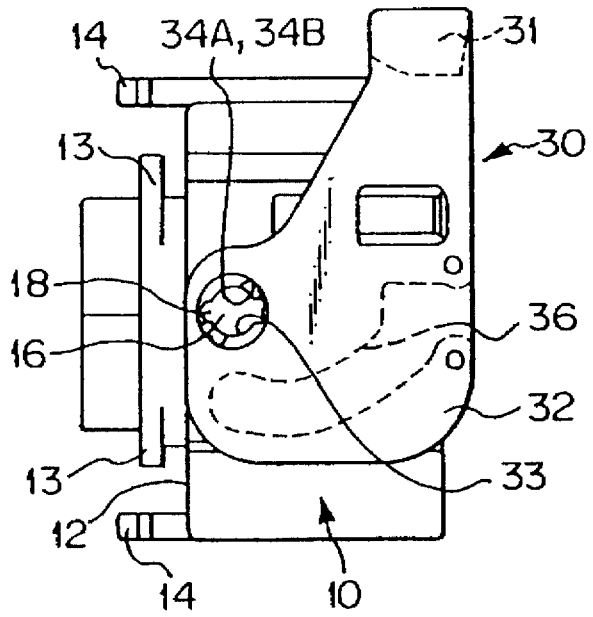
FIG. 14 is a side elevational view of the lever type connector in which the cover is removed from the female housing.
Figure 15:
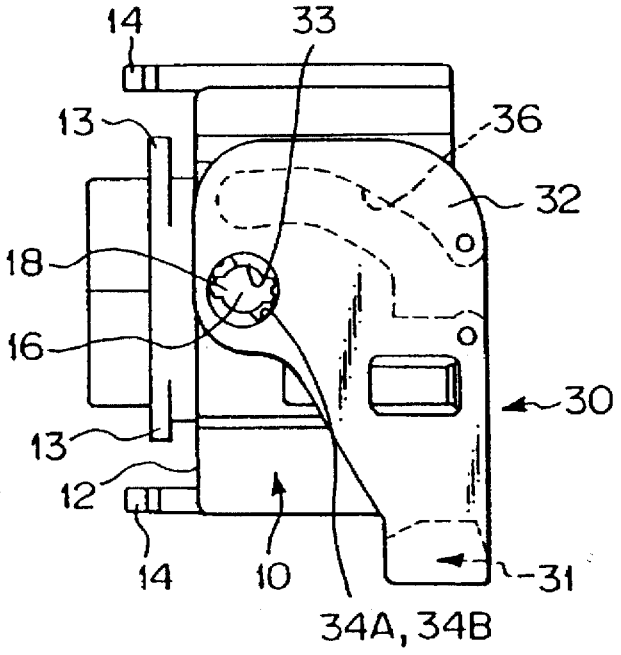
FIG. 15 is a side elevational view of the lever type connector in which the cover is mounted in a reversed direction to that in FIG. 14 on the female housing.

Since the lever 30 can be mounted on the female housing 10 in either one of two postures shown in FIGS. 14 and 15 as well as the cover 20 can be mounted on the housing 10 in either one of two postures shown in FIGS. 12 and 13 in this embodiment, the same parts can assembled the connector by four ways. Accordingly, it is possible to reconcile an improvement of operating the lever and a reduction of stress in the wires W regardless of any restrictive environment in attaching the connector.

It will be understood that the present invention is not limited to the embodiment described above. The present invention may be modified to the following various alterations within the scope of the spirit of the present invention:

(1) The present invention may be applied to a connector in which the male and female housings 40 and 10 are interconnected to each other without using the lever, although the above embodiment is referred to the lever type connector.

(2) Only the lock member on the cover may be symmetrical with respect to the wire exit direction or both lock members on the female housing and cover may be in symmetry with respect to the direction, although only the engaging portion 14 on the female housing 10 as the lock member is in symmetry with respect to the direction in this embodiment. The number and location of these lock members may be varied so long as they are in symmetry with the direction.

(3) The present invention may be applied to a connector in which the cover is not a sliding type and is moved towards and from the wire-drawing surface, although the cover 20 is mounted on the female housing 10 by sliding on the wire-drawing surface 12 in this embodiment.

Next, still another embodiment of the lever type connector in accordance with the present invention will be described below by referring mainly to FIGS. 16 to 23.

In this embodiment, the cover 20 is provided on opposite sides with the bridge-like flexible pieces 23 which extend in the longitudinal direction of the female housing 10 and are supported on the cover 20 at the opposite ends. The flexible piece 23 is elastically deformed towards and from the side surface of the cover 20, that is, in the fitting position of the lever 30.

Two holding projections 24, 24 adapted to engage with the engaging piece 14 on the female housing 10 are arranged on the flexible piece 23 longitudinally. One of the holding projections 24, 24 engages with the engaging piece 14 when the cover 20 is in the locked position, thereby maintaining the cover 20 in the locked position. Both holding projections 24 and 24 engages with the opposite sides of the engaging portion 14 when the cover 20 is in the unlocked position, thereby maintaining the cover 20 in the unlocked position. The maintenance of the cover 20 in the lock or unlocked position is released by elastically deforming so that the flexible piece 23 approaches the cover 20. Upon mounting the cover 20 on the female housing 10, the holding projections 24, 24 does not interfere the attachment of the cover 20 to the housing 10, since the slanted faces of the projections 24, 24 engage with the engaging piece 14 so as to elastically deform the flexible piece 23.

The flexible piece 23 is provided with the push finger 27 which serves to turn the lever 30 in the fitting position to the fitting-releasing position. The push finger 27 projects at a position shifted slightly from the longitudinal center of the flexible piece 23 and is disposed adjacent to the lock pawl 25. Accordingly, when the cover 20 is in the locked position, the push finger 27 is opposed to the escape slot 38 in the lever 30.

When the flexible piece 23 is elastically deformed, the push finger 27 approaches the cover 20. When the cover 20 under this state is displaced to the unlocked position, the push finger 27 enters recess **39*b* contiguous to the escape slot 38 and is opposed to a bearing face 38*a* of the recess 39*b* with a slight clearance. The push finger 27 will engage with the bering face 38*a* as the flexible piece 23 elastically recovers while the push finger 27 enters the space between the lever 30 and the cover 20, thereby applying a biasing force to the fitting releasing direction to the operational handle 31 of the lever 30**.

Moreover, the flexible piece 23 is provided with the stepped button **23*a*. When the stepped button 23*a* is pushed downward and laterally, it is possible to apply to the flexible piece 23 a force of deforming it elastically and a force of sliding the cover 20** from the locked position to the unlocked position at the same time.

Next, an operation of this embodiment will be described below.

The cover 20 mounted on the female housing 10 is maintained in the locked position by engagement of the holding projection 24 and engaging piece 14 and the lock pawl 25 on the cover 20 is ready for locking the lock pawl 37 on the lever 30. If the lever 30 is turned to couple the male housing 40 to the female housing 10, the lock pawl 37 engages with the lock pawl 25 after coupling of the housings is complete and the lever reaches the fitting position, thereby maintaining the lever 30 in the locked position and the housings in the fitting position.

Upon disconnecting the housings from each other, the stepped buttons **23*a*, 23*a* on the flexible piece 23 are clamped manually. For example, if the cover is clamped between a thumb and a forefinger since the flexible pieces 23, 23 are provided on the opposite sides of the cover 20, the flexible pieces 23, 23 are elastically deformed and the holding projections 24, 24 on the pieces 23, 23 are unlocked from the engaging pieces 14, 14 on the female housing 10. Then, the push finger 27 approaches the cover 20**.

When the cover 20 is slid to the unlocked position while elastically deforming the flexible pieces 23, the lock pawl 25 is disengaged from the lock pawl 37 to release the lever 30 from the fitting position and the push finger 27 enters the recess **39*b* in the lever 30 to oppose the bearing face 38*a*** with a slight clearance.

If the flexible pieces 23, 23 is released from the pushing force, the deformed flexible pieces 23, 23 recovers and the push fingers 27, 27 are displaced by the elastic recovery force of the pieces 23, 23 so as to move away from the cover 20 and to engage with the bearing face **38*a*. This results in movement of the handle 31 of the lever 30** to the fitting-releasing position.

Thus, since there is a sufficient space between the handle 31 and the cover 20 to receive a worker's finger, the handle can be easily hooked by the finger even if the handle is not visible.

Thus, the lever 30 can be turned to the fitting-releasing direction by hooking the handle 31 by a worker's finger. The turning of the lever 30 disconnects the male and female housings from each other.

As described above, according to the above embodiment of the lever type connector, since the handle 31 of the lever 31 is spaced away from the cover 20 so as to hook the handle 31 upon fitting the male and female housings, it is possible to easily operate the handle 31 even if the handle 31 is not visible.

Since the cover 20 is maintained in the locked position by engagement of the holding projection 24 and engaging piece 14 when the cover 20 is in the locked position and the lever 30 is locked in the fitting position, the cover 20 is not moved to the unlocked position to release the lock of the lever 30 even if the cover is pushed to the unlocked position by interference with the other members.

In particular, an unlocking operation of the lever 30 is significantly improved because the unlocking action of the cover 20 from the locked position and the displacing action of the cover 20 to the unlocked position can be effected by a single operation while positively locking the lever 30 by maintaining the cover 20 in the locked position.

The push finger 27 does not interfere with the lever 30 until the finger 27 moves to the position in which the finger 27 applies the elastic force to the lever 30. Accordingly, in comparison with the case where the elastic pushing force is gradually increased by contact with the lever 30 as the lever 30 moves, there occurs no contact resistance associated with displacement of the push finger 27. Consequently, the push finger 27 can be easily displaced.

Further, according to this embodiment, the lever 30 can be pushed to the fitting-releasing direction when the cover 20 is displaced to the position in which the lever 30 is unlocked. Accordingly, the displacing stroke of the cover 20 is shorter than that in the case where the lever 30 is pushed to the fitting-releasing direction by utilizing a slanted face and the like while further displacing the cover after the cover 20 is displaced until the lever 30 is unlocked.

It will be understood that the present invention is not limited to the embodiment described above. The present invention may be modified to the following various alterations within the scope of the spirit of the present invention:

(1) The lever may be provided with means for biasing the lever to the fitting-releasing direction, although the lever 30 is biased to the fitting-releasing direction by the elastic recovery force of the flexible piece 23 on the cover 20 in the above embodiment.

(2) The present invention may be applied to a case where the lever turns while displacing in the longitudinal direction of the female housing, although the lever 30 turns on the side faces of the female housing 10 in this embodiment.

(3) The lock pawl 25 may be provided on not the cover 20 but the female housing 10, although the lock pawl 25 which serves to lock the lever 30 is provided on the cover 20 in the above embodiment.

(4) The lock pawl 25 and push finger 27 may be moved cross the longitudinal axis of the handle 31, although the lock pawl 25 and push finger 27 are displaced in the longitudinal axis of the handle 31 of the lever 30 in the above embodiment.

(5) The flexible piece 23 may be provided on eider side of the cover 20, although the flexible piece 23 are provided on the opposite sides of the cover 20 in the above embodiment.

Next, still another embodiment of the lever type connector having a waterproofing function in accordance with the present invention will be described below by referring mainly to FIGS. 24 to 29.

This embodiment of the lever type connector having a waterproofing function comprises the male housing 40, the female housing 10, and a waterproofing rubber ring 60 adapted to be mounted on the female housing 10. In the drawings, the cover 20 and lever 30 are omitted.

The female housing 40 contains a plurality of male terminals 41 in a plurality of cavities provided in the housing 40 with tabs on the distal ends of the terminals 41 projecting in the interior of a hood 412 which extends forward from the housing 40. The front and rear sides of the hood 412 and male terminal 41 are defined in accordance with the front and rear sides of female terminals 50 in the female housing 10 and the rubber ring 60, as described below.

It should be noted that the male and female housings 40 and 10 are interconnected to each other back and forth, as described above, so the "back and forth" direction is referred to as the "fitting direction" hereinafter.

The female housing 10 contains a plurality of terminals 50 in a plurality of cavities 11 in the housing 10 so that the female terminals 50 are opposed to the male terminal 41. The female terminal 50 is provided with an elastic contact piece 523. When the male and female terminals 41 and 50 are interconnected to each other, the elastic contact piece 523 elastically presses the tab on the male terminal 41 thereby electrically conducting the terminals 41 and 50 with a given contact pressure.

The female housing 10 is provided with a guide cylinder 124 which extends forward from the rear end edge and encloses an outer periphery of the housing 10. An open receiving space 125 is defined in a front part of a space between the inner periphery of the guide cylinder 124 and the other periphery of the female housing 10. The hood 412 of the male housing 40 enters the receiving space 125 when the male and female housings 40 and 10 are interconnected. The guide cylinder 124 guides the hood 412 to interconnect the male and female terminals 41 and 50 to each other in the regular positional relationship. The inner diameter of the guide cylinder 124 is far greater than the outer diameter of the hood 412. Consequently, the hood 412 can slightly move in the receiving space 125 in a direction perpendicular to the fitting direction. This can absorb a shift of coupling position caused due to a dimensional tolerance.

The rubber ring 60 is mounted in the receiving space 125 with the inner periphery being in close contact with the outer periphery of the female housing 10 and an end being in contact with a bearing face 126 of an inner part of the space 125. The shape in cross section of the rubber ring is in symmetry with respect to the axial direction. The rubber ring can be mounted on the female housing 10 regardless of the direction of the rubber ring 60.

The axial direction of the rubber ring 60 coincides with the fitting direction of the male and female housings 40 and 10. Accordingly, the axial direction is referred to as "the fitting direction" hereinafter.

Figure 27:
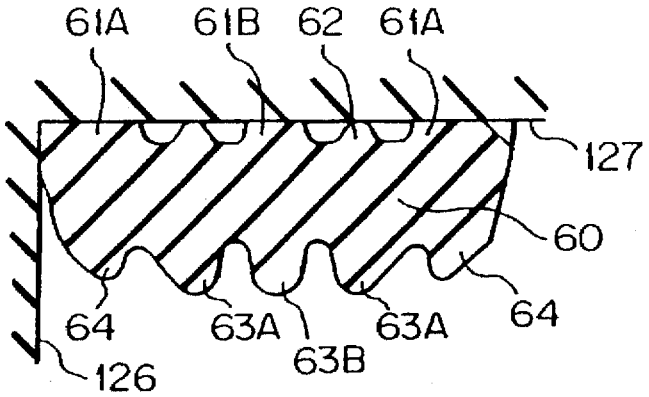
FIG. 27 is an enlarged longitudinal sectional view of an embodiment of a rubber ring.

As shown in FIG. 27, the rubber ring 60 is provided on its inner periphery with three antislip portions 61A, 61B, 61A, which serve to generate a frictional resistance and to prevent the ring from shifting in the fitting direction by means of wide surface contacts with the outer periphery of the female housing 10, and with two sealing portions 62, 62, which serve to seal the housings by means of narrow surface contacts with the outer periphery. The antislip portions and sealing portions are arranged alternately.

On the other hand, the rubber ring 60 is provided on its outer periphery with three lip portions 63A, 63B, 63A which are elastically compressed by the inner periphery of the hood 412 when the housings 40 and 10 are coupled to each other. The lip portions 63A, 63B, 63A are arranged in association with the sealing portion 62, antislip portion 61B, and sealing portion 62, respectively. When these lip portions 63A, 63B, 63A are compressed, the antislip portion 61B and sealing portions 62, 62 are strongly pushed to the female housing 10.

The rubber ring 60 is also provided on its opposite ends of the outer periphery with a leading-fitting portion 64. The three lip portions 63A, 63B, 63A are arranged between the two leading-fitting portions 64, 64. The leading-fitting portions 64 are lower than the lip portions 63A, 63B, 63A. However, the leading-fitting portions 64, 64 can be elastically compressed when the hood 412 of the male housing 40 enters the receiving space 125.

The length and location of the rubber ring 60 in the fitting direction are determined as follows. In the case of interconnecting the male and female housings 40 and 10 to each other, the tab on the male terminal 41 is not yet pressed by the elastic contact piece 523 of the female terminal 50 at the time when the distal end of the hood 412 commences to come into contact with the leading-fitting portion 64 in the inlet side and the tab is pressed by the piece 523 after the distal end of the hood 412 has fitted to the leading-fitting portion 64.

Next, an operation of this embodiment will be explained below.

Upon interconnecting the housings 10 and 40, the distal end of the hood 412 of the male housing 40 engages with the leading-fitting portion 64 of the rubber ring 60 at first. At this time, the leading-fitting portion 64 is elastically compressed by the inner periphery of the hood 412 and this elastic recovery force in the portion 64 pushes the hood 412 outwardly.

Figure 24:
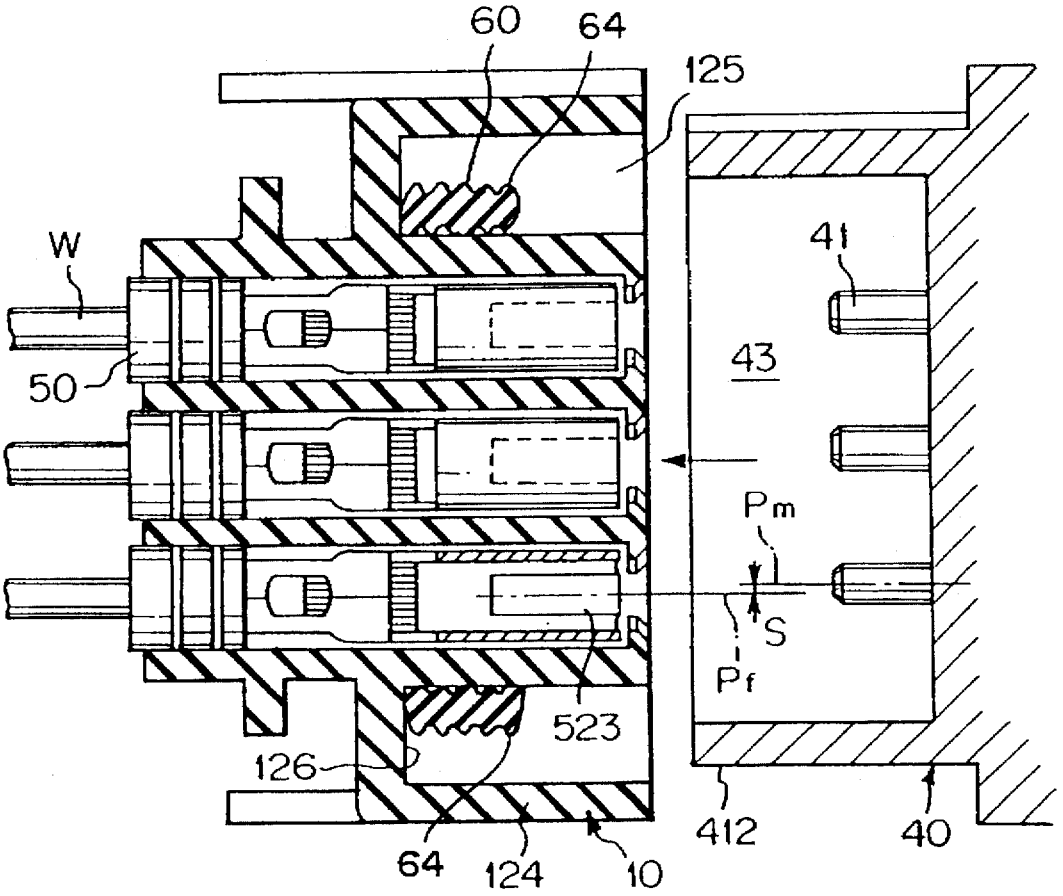
FIG. 24 is a longitudinal sectional view of another embodiment of the lever type connector of the present invention, illustrating both housings which are in a position prior to be fitted to each other.
Figure 25:
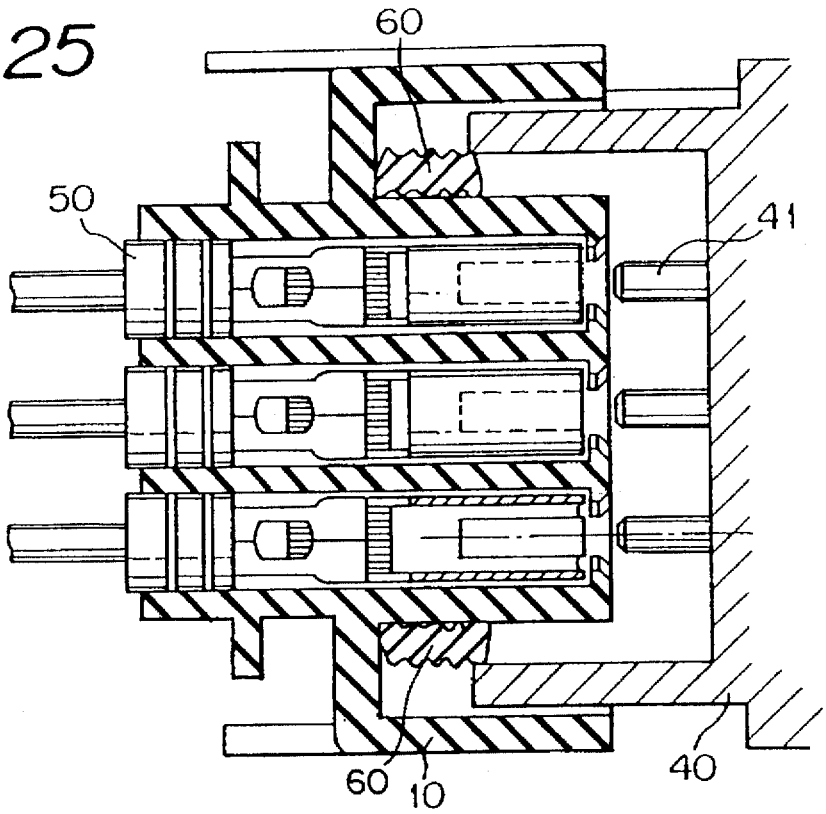
FIG. 25 is a longitudinal sectional view of the lever type connector in which a male housing is coupled to a leading engagement portion of a rubber ring in a female housing.
Figure 26:
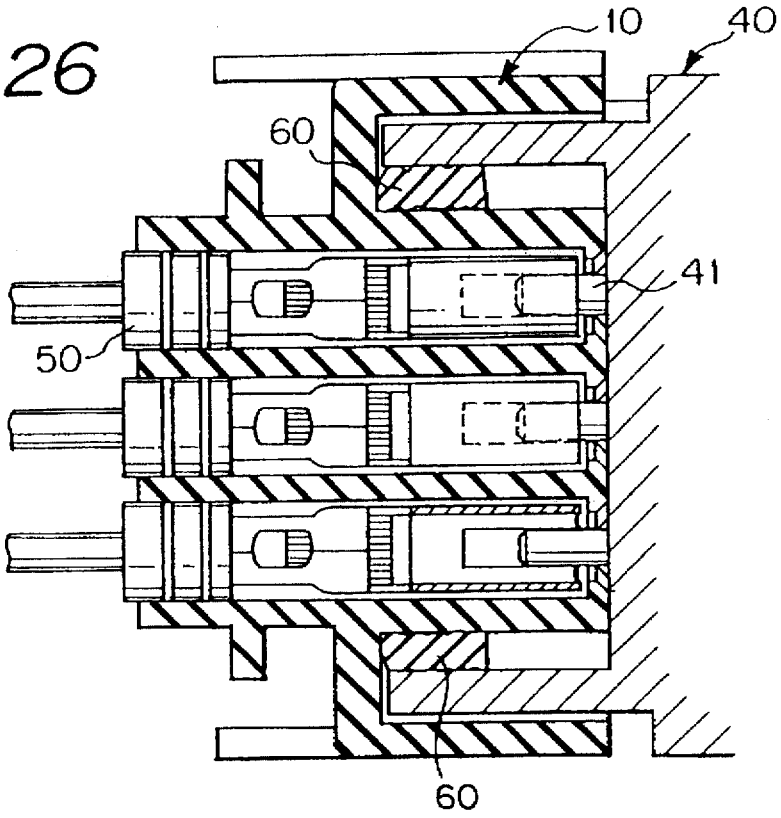
FIG. 26 is a longitudinal sectional view of the lever type connector shown in FIG. 24 in which both housings have finished coupling to each other.

As shown in FIG. 24, an alignment error in a direction across the fitting direction occurs between the housings 10 and 40. If a shift S occurs between the center line $P_m$ of the male terminal 41, in space 43 of male housing 40, and the center line $P_f$ of the female terminal 50, deflections of the leading-fitting portions 64, 64 in the direction of the alignment error (vertical direction in the drawing) becomes different. The leading-fitting portion 64 at the greater deflection side strongly pushes the hood 412 outwardly.

Since the male and female terminals 41 and 50 do not yet start coupling to each other in this state and the hood 412 can move in a direction across the fitting direction in the receiving space 125, the hood 412 can be displaced relative to the female housing 10 by the elastic recovery force in the leading-fitting portion 64 to correct the shift. Consequently, the alignment error between the housings 10 and 40 is corrected and thus the center lines $P_m$ and $P_f$ of the male and female terminals coincide with each other. The deflections of the leading-fitting portions 64, 64 are equalized in connection with the correction of the alignment error (see FIG. 25).

Thereafter, the housings 10 and 40 are interconnected to each other while maintaining the center lines $P_f$ and $P_m$ in alignment with each other and the tab on the male terminal 41 is elastically pressed by the elastic contact piece 523. After the tab is pressed by the piece 523, any shift between the center lines $P_f$ and $P_m$ can be prevented by the frictional resistance caused between the terminals. Thus, the coupling of the housings proceeds while the center lines $P_f$ and $P_m$ of the terminals 50 and 41 are in alignment with each other.

Meantime, the hood 412 corrected coaxially with the rubber ring 60 is fitted to the lip portions 63A, 63B, and 63A in order so as to elastically compress them. Since there is no alignment error between the hood 412 and the rubber ring 60 after the tab is pressed by the elastic contact piece 523, the interconnection of the hood 412 and rubber ring 60 proceeds while maintaining the elastic deflections at the opposite sides of the ring 60 in the same amount.

After the interconnection is complete there is no alignment error between the hood 412 and the rubber ring 60 and the leading-fitting portions 64, 64 and the lip portions 63A, 63B, 63A of the rubber ring 60 are uniformly deflected, thereby equalizing the pushing pressure between the female housing 10 and the antislip portions 61A, 61B, sealing portions 62, 62. Accordingly, the sealing effects between the inner periphery of the rubber ring 60 and the female housing 10 and between the outer periphery of the rubber ring 60 and the hood 412 are equalized, thereby enhancing the waterproofing function.

It will be understood that the present invention is not limited to the embodiment described above. The present invention may be modified to the following various alterations within the scope of the spirit of the present invention:

(1) The rubber ring may be closely mounted on the guide cylinder, although the rubber ring 60 is closely mounted on the female housing 10 in the above embodiment.

(2) The rubber ring may be mounted on the male housing, although the rubber ring 60 is mounted on the female housing 10 in the above embodiment.

Figure 28:
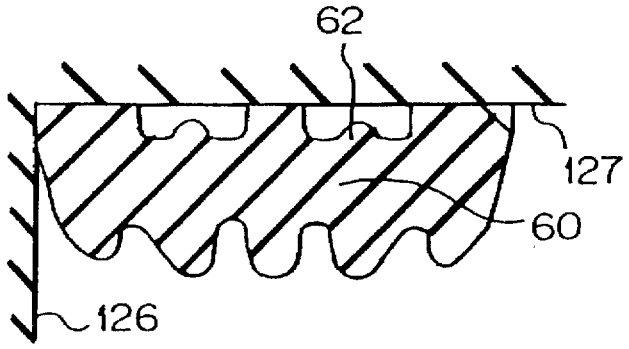
FIG. 28 is an enlarged longitudinal sectional view of another embodiment of the rubber ring.
Figure 29:
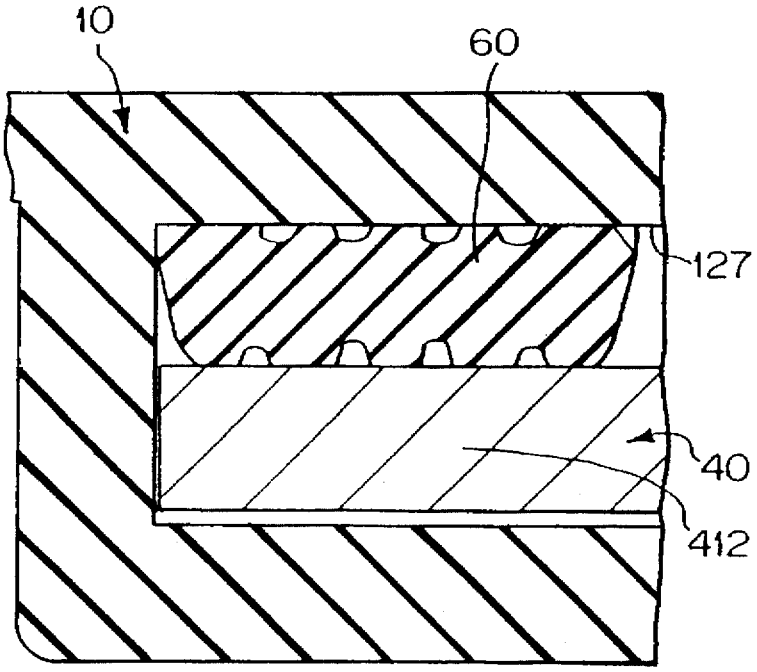
FIG. 29 is an enlarged longitudinal sectional view of another embodiment of the rubber ring, illustrating the rubber ring which is elastically deformed.

(3) A rubber ring 60 shown in FIGS. 28 and 29 may be used as another embodiment exclusive of the above embodiment.

When the hood 412 is not fitted to the rubber ring 60, two sealing portions 62 and 62 on the inner periphery are spaced away from the outer periphery of the female housing 10 by a slight distance (see FIG. 28). When the hood 412 is fitted to the rubber ring 60, the sealing portions 62, 62 come into close contact with the outer periphery of the female housing 10 while being elastically deformed (see FIG. 29).

Upon mounting the rubber ring 60 on the female housing 10, the frictional resistance therebetween is reduced and this results in an efficient work. If the rubber ring 60 is elastically deflected by the fitting of the hood 412, contact areas between the sealing portions 62, 62 and the outer periphery of the female housing 10 are increased to raise the contact pressure, thereby performing a high sealing effect.

Figure 30:
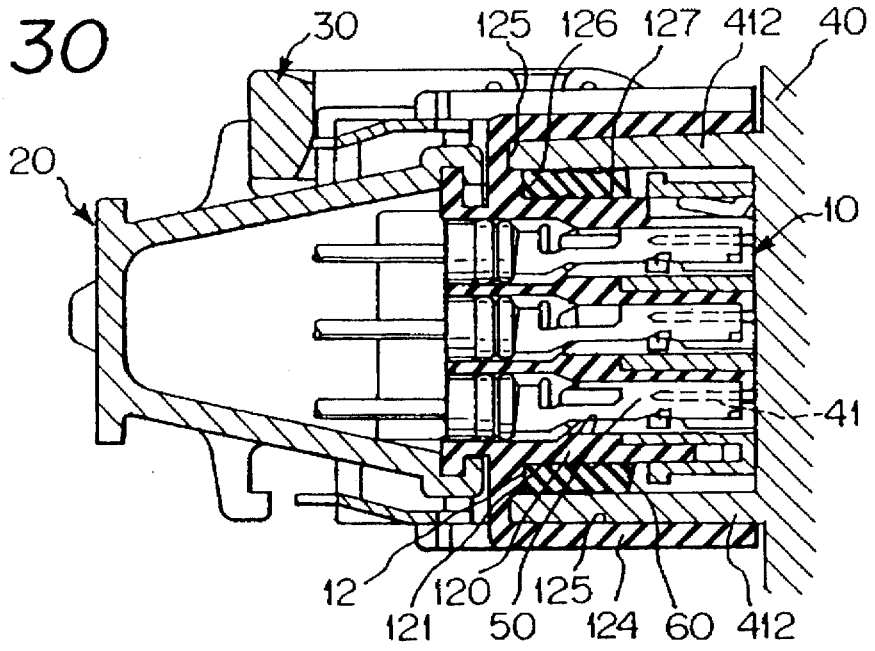
FIG. 30 is a longitudinal sectional view of the lever type connector in which the housings are interconnected.
Figure 31:
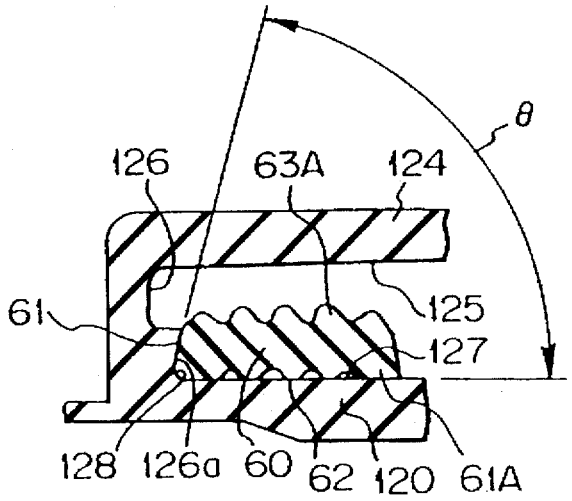
FIG. 31 is a fragmentary enlarged longitudinal sectional view of the rubber ring.
Figure 32:
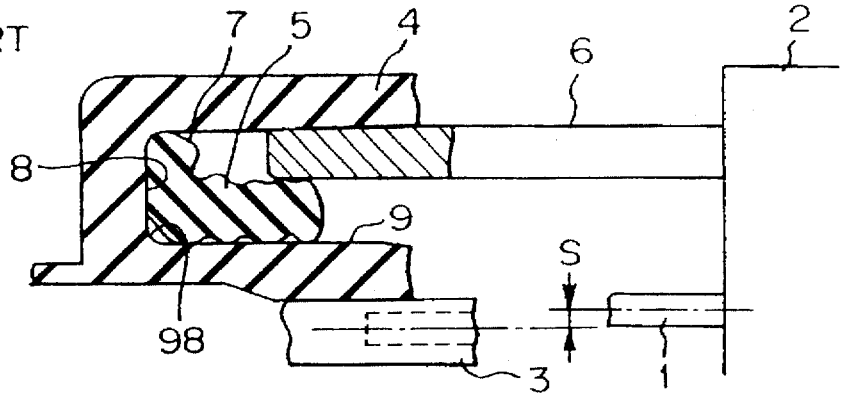
Fig. 32 PRIOR ART
FIG. 32 is a fragmentary enlarged longitudinal sectional view of a conventional lever type connector.

Next, still another embodiment of the lever type connector having a waterproofing function in accordance with the present invention will be described below by referring mainly to FIGS. 30 and 31.

This embodiment of the lever type connector having a waterproofing function comprises the male housing 40, the female housing 10, and the waterproofing rubber ring 60 adapted to be mounted on th female housing 10. In the drawings, the cover 20 and lever 30 are omitted.

The male housing 40 contains a plurality of male terminals 41 in a plurality of cavities provided in the housing 40 with tabs on the distal ends of the terminals 41 projecting in the interior of a hood 412 which extends forward from the housing 40.

The female housing 10 contains a plurality of terminals 50 in a plurality of cavities 11 in the housing 10 so that the female terminals 50 are opposed to the male terminal 41. The female housing 10 is provided with a guide cylinder 124 which extends forward (towards the male housing 40) from the rear end edge and encloses an outer periphery of the housing 10.

An open receiving space 125 is defined in a front part of a space between the inner periphery of the guide cylinder 124 and the outer periphery of the female housing 10. The hood 412 of the male housing 40 enters the receiving space 125 when the male and female housings 40 and 10 are interconnected. When the hood 412 is inserted into the receiving space 125, the hood 412 is guided by the guide cylinder 124 by sliding the outer periphery of the hood 412 on the inner periphery of the guide cylinder 124, so that the male and female terminals 41 and 50 can be interconnected to each other in the regular positional relationship.

The receiving space 125 is provided in its inner part with a receiving slot **126*a* which extends along the inner periphery of the guide cylinder 124. The space 125 is also provided in its inner part with a bearing face 126 which receives an inner end face 61 of the rubber ring 60 mounted on the female housing 10 and is formed along an inner edge in the receiving slot 126***a*. The side of rubber ring 60 rests against inner wall 120 which is spaced apart radially inwardly from guide cylinder 124. Inner surface 121 faces terminals 41 and 50. The receiving face 126 stands up from the outer periphery of the female housing 10, which is parallel to the fitting direction of the housings 10 and 40 and is slanted to slightly overhang on the outer periphery of the housing 10. That is, an angle θ between the bearing face 126 and the outer periphery 127 of the female housing 10 is smaller than 90°. If the end of the rubber ring 60 is pushed onto the bearing face 126 in the fitting direction, the end of the ring 60 is subject to a force which is directed to the outer periphery 127 of the female housing 10 along the slanted bearing face 126. Thus, the restraining means is constructed.

The rubber ring 60 is closely mounted on the outer periphery 127 of the female housing 10 (one of the housings specified in the claim) prior to interconnection of the housings 10 and 40. The shape in cross section of the rubber ring 60 is in symmetry with respect to the fitting direction, so the rubber ring 60 may be mounted on the female housing 10 regardless of the direction of the ring.

The rubber ring 60 is provided on its inner periphery with the antislip portions 61A which prevents the ring from shifting in the fitting direction by the frictional resistance caused by wide contact areas with the outer periphery 127 of the female housing 10 and with the sealing portions 62 which seals the housings by narrow contact areas with the outer periphery 127.

On the other hand, the rubber ring 60 is provided on its outer periphery with three lip portions 63A, 63B, 63A which are elastically compressed by the inner periphery of the hood 412 when the housings 40 and 10 are coupled to each other. The lip portions 63A, 63B, 63A are arranged in association with the sealing portion 62, antislip portion 61B, and sealing portion 62, respectively. When these lip portions 63A, 63B, 63A are compressed, the antislip portion 61B and sealing portions 62, 62 are strongly pushed to the female housing 10.

The opposite end faces 61, 61 of the rubber ring 60 in the fitting direction (they are opposed to the bearing face specified in the claims) are slanted in parallel to the bearing face 126 of the female housing 10. That is, an angle θ between the end face 61 of the rubber ring 60 and the longitudinal axis is set to be smaller than 90°. Accordingly, one of the end faces 61, 61 of the rubber ring 60 can come into close contact with the whole bearing face 126.

Next, an operation of this embodiment will be explained below.

In order to couple the male housing 40 to the female housing 10 on which the rubber ring 60 is mounted beforehand, the hood 412 moves forward in the fitting direction in the receiving space 125 while elastically compressing the lip portions 63A of the rubber ring 60. At this time, the rubber ring 60 is subject to the pushing force towards the inner part of the receiving space 125 (in the fitting direction) by the resistance between the hood 412 and the lip portions 63A.

However, the rubber ring 60 is prevented from moving in the fitting direction by a pushing action of the hood 412 by means of engagement of the end face 61 of the rubber ring 60 with the bearing face 126. A direction in which the end face 61 of the rubber ring 60 and the bearing face 126 stand from the inner peripheral side to the outer peripheral side is not perpendicular but inclined to the fitting direction. Thus, the distal end of the rubber ring 60 pushed to the fitting direction is subject to a force which introduces the distal end towards the outer periphery of the female housing 10, thereby restraining the rubber ring from escaping from the outer periphery 127 outwardly. Accordingly, it is possible to prevent the rubber ring 60 from shifting in the fitting direction while elastically deforming outwardly along the bearing face.

Since the connecting part 128 between the outer periphery of the female housing 10 and the bearing face 128 has to be slightly curved under a certain forming condition, the distal end of the rubber ring 60 might be elastically deformed outwardly at the connecting part 128 by guidance of the curved face. However, since an elastic deformation towards the outside is limited within a small area on the distal end of the rubber ring 60, the almost distal end of the rubber ring 60 is introduced inwardly by means of the inclination of the bearing face 126 and end face 61 of the rubber ring 60.

As described above, since the distal end of the rubber ring 60 is introduced inwardly by receiving the distal end face 61 of the rubber ring 60 pushed in the fitting direction on the slanted bearing face 126, the rubber ring 60 can be positively prevented from elastically shifting in the fitting direction while elastically deforming the distal end outwardly.

As another means for preventing the distal end of the compressed rubber ring in the fitting direction from elastically deforming outwardly, there is a flange provided around the distal end of the rubber ring 60 which is adapted to come into contact with the inner periphery of the guide cylinder 124. This structure requires an additional length in the fitting direction for the female housing 10 by a thickness of the flange. On the contrary, this embodiment can avoid increase of size in the female housing 10 because the embodiment needs no flange.

It will be understood that the present invention is not limited to the embodiment described above. The present invention may be modified to be following various alterations within the scope of the spirit of the present invention:

(1) The rubber ring may be closely mounted on the guide cylinder, although the rubber ring 60 is closely mounted on the female housing 10 in the above embodiment.

(2) The rubber ring may be mounted on the male housing, although the rubber ring 60 is mounted on the female housing 10 in the above embodiment.

(3) The bearing face may be slanted and the opposite end faces of the rubber ring may cross the coupling direction, although the bearing face 126 and the opposite end faces of the rubber ring 60 are slanted in this embodiment.

(4) The restraining means may include a slot in the rubber ring, in which the inner end of the rubber ring can be inserted so that the side edge of the slot prevents the rubber ring from escaping from the bearing face, although the restraining means is the tapered bearing face in this embodiment.

What is claimed is:

1. A lever type connector comprising a pair of housings, said pair consisting of a first housing and a second mating housing, said housings adapted to be interconnected by rotation of a lever attached to one of said housings, said first housing containing a plurality of terminals each of which is adapted to be detachably coupled to a corresponding mating terminal contained in said mating housing, said first housing adapted to draw out an electric wire clamped in each terminal through a wire-drawing surface;

a pair of support axles formed on said first housing;

a U-shaped lever rotatably and detachably mounted on said first housing by coupling said pair of support axles in a pair of bearing holes formed in opposed leg portions of said lever;

a cover detachably mounted on said wire-drawing surface of said first housing to protect said electric wires;

a locater for positioning said cover in a given mounting position on said first housing, said locater including engaging portions formed on said first housing and cover;

said lever being selectively mounted on said first housing in a reversible manner upon coupling between said pair of support axles and bearing holes;

said lever adapted to rotate between a fitting position, in which said housings are interconnected, and a detached position, in which said housings are disconnected from each other, a handle of said lever being adapted to approach said second mating housing when said lever rotates to said fitting position;

wherein said cover is provided with a lock member which can move between a locked position, in which said lever is retained by engagement with said lock member, and an unlocked position, in which said lever is disengaged from said lock member, a lock-releasing member adapted to apply a force in an unlocking direction to said cover when said lever is in said fitting position whereby said lock member is moved to said unlocked position.

2. A lever type connector according to claim 1 wherein said terminals contained in said housings are interconnected in connection with the interconnection of both housings, and wherein a rubber ring mounted on said first housing is pressed by said mating housing, thereby waterproofing the interiors of both housings, and wherein said mating housing commences to elastically engage said rubber ring prior to the interconnection of said terminals upon the interconnection of said housings, whereby said rubber ring applies an elastic force to said housings to correct any relative displacement between said housings in a direction transverse to the coupling direction.

3. A lever type connector according to claim 1 wherein said lock-releasing member includes a pressure part for urging said lever into said unlocked position, said lock releasing member adapted to be elastically deflected and displaced together with said lock member, whereby said pressure part enters a space between said handle of said lever in said coupling position and said cover, when said lock-releasing member is displaced to said unlocked position.

4. A lever type connector according to claim 3 wherein said lock-releasing member is provided with a holding piece which can hold said lock member in said locked position when said holding piece engages said first housing and can be released from said first housing by means of elastic deflection of said lock-releasing member.

5. A lever type connector according to claim 1 wherein one of said housings to be interconnected supports a waterproofing rubber ring whereby an inner end face of said rubber ring abuts on a bearing face formed on said one housing, wherein said bearing face receives a pressure force against said rubber ring in said fitting position caused by frictional resistances between said housings upon the interconnection thereof, and wherein said bearing face is provided with a stop for preventing said rubber ring from separating from said first housing at the inner end when said rubber ring receives said pressure force in the coupling direction.

6. A lever type connector according to claim 5 wherein said stop is formed into a tapered shape so that said bearing face is slanted at an angle other than perpendicular to the coupling direction of said rubber ring, and wherein a face on said rubber ring confronting said bearing face is formed into a tapered shape with said slant angle.

7. A lever type connector according to claim 1 wherein a locking mechanism is provided on said support axles and bearing holes so as to restrain said leg portions from coming out of said first housing after said bearing holes receive said support axles in an axial direction, said locking mechanism being symmetrical with respect to an axis parallel to the coupling direction of the terminals.

8. A lever type connector according to claim 7, wherein said support axles are disposed on said housing so that the clockwise and counterclockwise moments around said support axles caused by the coupling resistances between said terminals are balanced to each other.

9. A lever type connector according to claim 7 wherein said locking mechanism includes a pair of enlarged portions projecting radially from the outer periphery of each support axle and a pair of recesses in the inner periphery of each bearing hole, each of said recesses being formed into a complementary shape to each of said enlarged portions, wherein said pair of enlarged portions and said pair of bearing holes are symmetrical about the axis of said support axles, and wherein one set of complementary enlarged portion and recess is different in shape from the other set of complementary enlarged portion and recess.

10. A lever type connector according to claim 9, wherein said recess is disposed in said bearing hole to be fitted to said enlarged portion when said lever is turned beyond a range for coupling said terminals.

11. A lever type connector according to claim 9 wherein said pair of enlarged portions comprises a first enlargement and a second enlargement and said pair of recesses comprises a first receiver and a second receiver, said first enlargement including a convex part, said first receiver including a concave part complementary thereto, said second enlargement including a concave part, said second receiver including a convex part complementary to said concave part of said second enlargement.

12. A lever type connector according to claim 11 wherein said first enlargement is diametrically opposed to said second enlargement and said first receiver is diametrically opposed to said second receiver.

* * * * *